United States Patent [19]

Finney

[11] Patent Number: 4,995,612

[45] **Date of Patent: * Feb. 26, 1991**

[54] GOLF CLUBHEAD IN A CORNER-BACK CONFIGURATION

[76] Inventor: Clifton D. Finney, 1057 Oak Hills Pkwy., Baton Rouge, La. 70810

[ * ] Notice: The portion of the term of this patent subsequent to Jan. 15, 2007, has been disclaimed.

[21] Appl. No.: 359,109

[22] Filed: May 31, 1989

Related U.S. Application Data

[63] Continuation-in-part of Ser. No. 289,908, Dec. 27, 1988, Pat. No. 4,898,387.

[51] Int. Cl.[5] ..... A63B 53/04

[52] U.S. Cl. ..... 273/169; 273/167 F

[58] Field of Search ..... 273/167–175, 273/77 A, 164, 163 R; D21/214–219

[56] References Cited

U.S. PATENT DOCUMENTS

| | | | |
|---|---|---|---|
| D. 202,715 | 11/1965 | Solheim | D21/219 |
| D. 203,275 | 1/1989 | Brayak | D21/217 |
| D. 207,227 | 3/1967 | Solheim | D21/217 |
| D. 220,506 | 4/1971 | Mader | D21/219 |
| D. 240,249 | 6/1976 | Chellman | D21/219 |
| D. 247,382 | 2/1978 | Adkins | D21/219 |
| D. 301,907 | 6/1989 | Muta | 273/169 X |
| D. 306,629 | 3/1990 | Shearer | 273/169 X |
| 1,671,956 | 4/1928 | Sime | 273/169 |
| 2,254,528 | 12/1941 | Hoare | 273/77 |
| 2,846,228 | 12/1958 | Reach | 273/169 |
| 3,655,188 | 4/1972 | Solheim | 273/77 A |
| 3,749,408 | 7/1973 | Mills | 273/171 |
| 3,967,826 | 7/1976 | Judice | 273/167 F |
| 4,063,733 | 12/1977 | Benedict | 273/80 C |
| 4,121,832 | 12/1978 | Ebbing | 273/171 |
| 4,325,553 | 4/1982 | Taylor | 273/167 F |
| 4,444,392 | 4/1984 | Duclos | 273/77 A |
| 4,508,350 | 4/1985 | Duclos | 273/183 D |
| 4,621,813 | 11/1986 | Solheim | 273/77 A |
| 4,653,756 | 3/1987 | Sato | 273/167 E |
| 4,715,601 | 12/1987 | Lamanna | 273/77 A |
| 4,741,535 | 5/1988 | Leonhardt | 273/164 |
| 4,795,157 | 1/1989 | Bencriscutto | 273/164 |
| 4,802,672 | 2/1989 | Long | 273/77 A |
| 4,832,344 | 5/1989 | Werner | 273/163 R |
| 4,852,879 | 8/1989 | Collins | 273/164 |

OTHER PUBLICATIONS

"Golf World", Magazine, (Jul. 2, 1976 issue), p. 31, Bottom Row, Left Side.

"Golf World", Magazine (Jan. 15, 1988 issue), p. 37.

"The Nugget", as seen in *Golf Digest*, Jun. 1976 issue.

*Primary Examiner*—Benjamin H. Layno

*Assistant Examiner*—Sebastiano Passaniti

[57] ABSTRACT

In its basic form, the corner-back configuration has a weight extending behind each corner of the ball striking surface. This may be viewed as a double split of the weights. The first split positions the weights toward the toe and heel, respectively, to reduce twisting along the vertical twist axis. The second split positions the respective toe and heel weights so that there are weights of the upper and lower toe together with weights of the upper and lower heel to reduce loft variations along the horizontal loft axis. The corner-back design offers the clubhead designer the opportunity to optimize moments of inertia and inertial efficiencies along both the vertical twist axis and the horizontal loft axis. The degree of optimization along a particular axis becomes his or her choice. The quantizing of the weights arises in part because of the need to constrain the center of mass of the clubhead. It is desirable that the center of mass be neither too far behind the striking face not too high on the clubhead. The corner-back clubhead may be regarded as a more inertially efficient substitute for the cavity-back model. A comparison of moments of inertia on representative corner-back and cavity-back near-clubheads was made. The corner-back configuration had a 33% greater moment about the vertical twist axis and an 88% greater moment about the horizontal loft axis than the cavity-back design.

19 Claims, 5 Drawing Sheets

GOLF CLUBHEAD IN A CORNER-BACK CONFIGURATION

CROSS-REFERENCE TO RELATED APPLICATIONS

The present work is a continuation-in-part application of the parent application entitled, "A Golf Clubhead with a High Polar Moment of Inertia," filed 27 Dec. 1988 under Ser. No. 07/289,908, and issued as U.S. Pat. No. 4,898,387 on 6 Feb. 1990.

BACKGROUND

1. Field of Invention

This invention relates to golf clubheads with enhanced moments of inertia along both the vertical twist and the horizontal loft axes through the geometric center of the striking face to reduce twisting and loft changes, respectively, when a golf ball is struck.

2. Description of Prior Art

Heretofore designers have tended to approach the problem of the two-dimensional inertial stability of a golf clubhead by providing variations of the cavity-back design. The cavity, sometimes oval in shape, is positioned on the rear of the clubhead behind the striking face. For heel-shafted clubs, the walls of the cavities may not be uniform in thickness due to the twin requirements for a low center of gravity and for a toe section that is heavier than the heel section. Accordingly, the sole wall of the cavity may be thicker and heavier than the top wall, and the toe wall may be thicker and heavier than the heel wall.

The origin of the cavity-back design may be traced to U.S. Pat. No. 1,671,936, May 29, 1928. For driving and other distance irons. Sime taught decreasing the width of the blade in the middle and increasing the width along the heel and toe, respectively. It is seen that this configuration would tend to enhance the moment of inertia along the vertical twist axis and thereby reduce the twisting of the clubhead to help prevent a hook or a slice when a ball is struck.

On the other hand U.S. Pat. No. 2,254,528, Sept. 2, 1941 by Hoare taught decreasing the width of the blade in the middle and increasing the width along the top and bottom, respectively. It is seen that this configuration would tend to enhance the moment of inertia about the horizontal loft axis and thereby reduce any loft change of the clubhead to help prevent being long or short when a ball is struck.

A combination of these ideas into a cavity back iron to assist in the simultaneous prevention of hooking or slicing and falling long or short may be found in U.S. Pat. No. 2,846,228, Aug. 5, 1958 by Reach. In Reach's clubhead the cavity could be filled with a light synthetic rubber matrix which, in turn, could hold a variable amount of a material such as lead oxide to meet the individual requirements of a golfer for weight.

A more contemporary cavity-back design for a correlated set of iron clubs may be seen in U.S. Pat. No. 3,655,188, Apr. 11, 1972 by Solheim. Here. the individual requirement of a golfer for weight was met y controlling the depth of the cavities.

An extension of this design may be seen in U.S. Pat. No. 4,621,813, Nov. 11, 1986, also by Solheim. Here, each of the heads in a set of iron clubs contained a sole with the trailing edge indented inward and upward at the middle. Material was redistributed to the heel and toe to further enhance the moment of inertia along the vertical twist axis. The basic teaching of the cavity-back configuration for the set of clubs was left intact.

BRIEF DESCRIPTION OF THE CURRENT INVENTION

In the present work the more inertially efficient corner-back configuration is substituted for the cavity-back design.

In its basic form the corner-back design has an upper toe weight extending behind the striking face from the top corner. There may also be a lower toe weight extending behind the striking face from the bottom corner. Upper and lower heel weights may occupy similar positions on the corners of the heel.

Thus, in this simple form of the corner-back clubhead there is a double split of the weights. The first split involves positioning weights on the heel and toe, respectively, to reduce twisting along the vertical twist axis. The second split involves positioning the respective toe and heel weights so that there are upper and lower toe weights together with upper and lower heel weights to reduce loft variations along the horizontal loft axis.

The definition of heel-to-toe polar inertial efficiency introduced in the parent application is retained. By way of brief review the inertial efficiency, E. of a clubhead was defined as the ratio of the actual experimental or computed polar moment of inertia to its theoretical moment of inertia. The inertial efficiency can also be regarded as an inertial coefficient or evaluator about that axis.

For practical purposes the actual moment of inertia was determined about a vertical axis through the geometric center of the striking face. Herein, this axis will often be referred to as the twist, heel-to-toe, or y-axis, and its inertial efficiency as $E_y$. The heel-to toe theoretical moment of inertia is the moment the clubhead would have if its mass were divided in two with the half-masses placed at pinpoints a clubhead length apart, and the moment determined through a vertical axis at the midpoint.

The definition of top-to-bottom polar inertial efficiency, $E_z$ is similar to $E_y$. Now, however, the actual moment of inertia is determined about a horizontal axis through the geometric center of the striking face that is parallel with the line used to determine the length of the clubhead. Herein, this axis will often be referred to as the loft, top-to-bottom, or z-axis. The top to-bottom theoretical moment of inertia is the moment the clubhead would have if its mass were divided in two with the half-masses placed at pinpoints a clubhead height apart, and the moment determined through a horizontal axis at the the midpoint.

The corner-back design, then, is the result of an effort to optimize $E_y$ and $E_z$ simultaneously. The quantizing of weights into a double split arises in part because of the constraints on the center of mass of the clubhead. It is desirable that the center of mass be neither too high nor too far behind the striking face.

Definitions for the length, width, and height of a clubhead soled in its normal address position which were provided in the parent application are retained. It is necessary to remember that height excludes any hosel and any neck. Definitions for the geometric center and the toe section of the clubhead are also retained.

Once again, the focus of effort will be placed upon the toe section with special emphasis on the upper toe because this region is apt to be the least complicated on the clubhead. That is, the heel typically contains the complicating feature of a hosel and the lower toe and heel weights may be joined by an extended sole.

To further isolate the most appropriate position for the upper toe weight, the toe section is sub-divided into eight rectangular parallelopipeds of equal volume. It will be seen that the most appropriate position for a substantial proportion of the upper toe weight is inside the corner rectangular parallelopiped at the uppermost extreme of the toe. This will be referred to as the corner rectangular parallelopiped of the upper toe, or more simply as the corner rectangular parallelopiped.

It will also be shown that there are optimal edges approximately parallel to the width line of the clubhead along which the upper and lower toe weights may be concentrated, respectively. These optimal edges provide an additional means for describing the invention.

OBJECTS AND ADVANTAGES

Accordingly, the several objects and advantages of my invention begin with a golf clubhead comprising an elongated striking face, a front, a back, a top, a sole, a toe, and a heel. A shaft may be fastened to the clubhead between the heel and toe. A vertical twist axis and a horizontal loft axis pass through the geometric center of the ball striking surface. The clubhead has a toe section and a heel section with the toe section having a corner rectangular parallelopiped in the extreme upper region of the toe. Finally, there are optimal edges approximately parallel with the width line of the clubhead positioned near the extreme regions of the upper and lower toe, respectively.

Another object is to have an upper toe weight attached to the clubhead so that it is a substantially discrete entity as it extends from behind the ball striking surface toward the back of the toe section.

Too, an object is to have a substantial part of the volume of the corner rectangular parallelopiped occupied with mass.

Yet another has the upper toe weight fastened to the clubhead so that it generally extends along the upper optimal edge toward the back of the toe section.

Still another provides that a lower toe weight be attached to the toe section so that it generally extends along the lower optimal edge toward the back of the toe section.

Another object involves arranging the mass of the toe section in a manner so that the polar moments of inertia and inertial efficiencies along the vertical twist axis and the horizontal loft axis are enhanced.

Yet another provides that a substantial percentage of the mass of the toe section be positioned in the corner rectangular parallelopiped of the upper toe.

Still another provides that the center of mass of that portion of the toe section in the corner rectangular parallelopiped is behind the striking face in the region of the upper toe.

Another object of my invention provides for positioning the mass in the corner rectangular parallelopiped of the upper toe so that the loft and twist compression ratios are simultaneously enhanced. These compression or design ratios will be defined within.

Other objects and advantages of the current invention are to provide a golf clubhead that is not necessarily heavier, longer, broader, or higher than ordinary; yields a good solid feel when a ball is struck; is aesthetically appealing to golfers; is readily constructed with advanced technologies such as body casting; and is commercially attractive for both manufacturer and golfer.

Still more objects and advantages of my invention will become apparent from the drawings and ensuing description of it.

NUMERIC CODE

Figure 10:
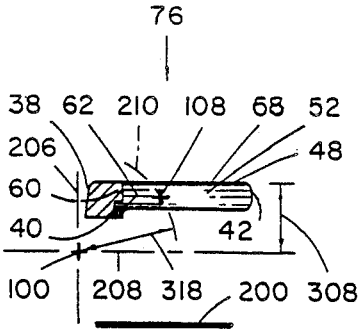
FIG. 10 is a cross-sectional side elevation view of the portion of the toe section of FIGS. 8 and 9.
Figure 11:
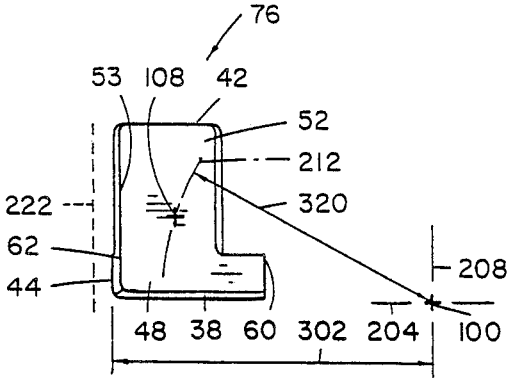
FIG. 11 is a top plan view of the portion of the toe section of FIGS. 8–10.
Figure 12:
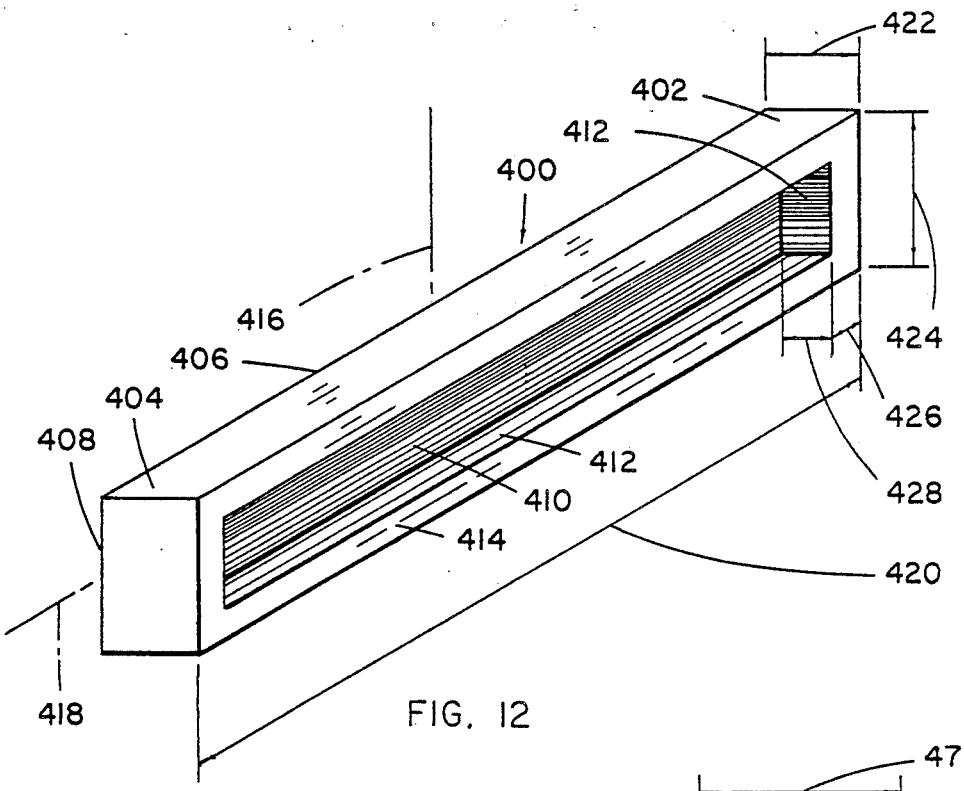
FIG. 12 is a schematic representation of a cavity-back design as a near-clubhead similar to clubheads of the prior art.
Figure 13:
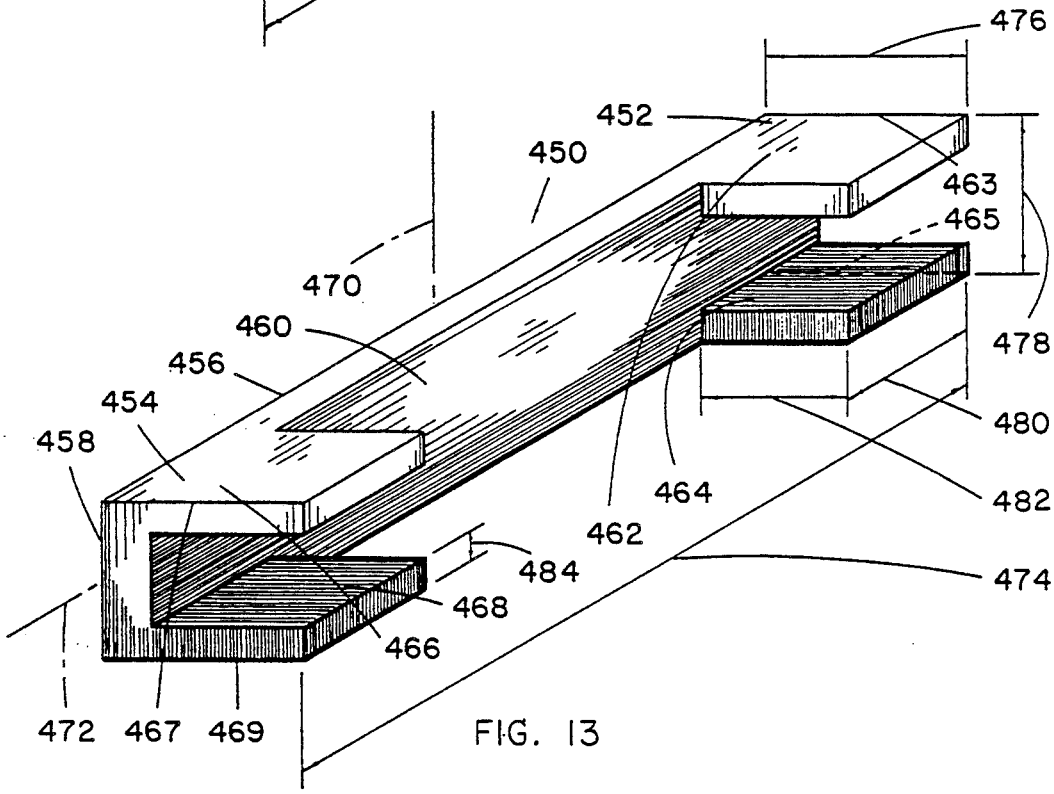
FIG. 13 is a schematic representation of a corner-back design as a near-clubhead similar to clubheads of the present invention.

| | |
|---|---|
| 1–29 | FIGURES |
| 30–99 | PARTS OF A PREFERRED EMBODIMENT FIGS. 1–11 |
| 100–199 | POINTS FIGS. 1–11 |
| 200–299 | AXES, LINES, SURFACES, AND ANGLES FIGS. 1–11 |
| 300–399 | DIMENSIONS FIGS. 1–11 |
| 400–499 | SCHEMATIC DIAGRAMS FIGS. 12 and 13 |

PARTS OF A PREFERRED EMBODIMENT FIGS. 1–11

| | |
|---|---|
| 30 | golf club putter |
| 32 | head |
| 34 | shaft |
| 36 | hosel |
| 36a | arm |
| 36b | collar |
| 36c | neck |
| 38 | ball striking surface |
| 40 | rear surface |
| 42 | back |
| 44 | toe |
| 46 | heel |
| 48 | top |
| 50 | sole |
| 52 | upper toe weight |
| 53 | upper optimal edge of toe 44 |
| 54 | lower toe weight |
| 55 | lower optimal edge of toe 44 |
| 56 | upper heel weight |
| 58 | lower heel weight |
| 60 | top brace |
| 62 | side brace on toe 44 |

-continued

| | |
|---|---|
| 64 | side brace on heel 46 |
| 66 | extended sole |
| 68 | body casting |
| 70 | toe section |
| 72 | heel section |
| 74 | corner rectangular parallelopiped of upper toe 44 |
| 76 | portion of toe section 70 in corner rectangular parallelpiped 74 |
| | POINTS FIGS. 1-11 |
| 100 | geometric center of ball striking surface 38 |
| 102 | center of golf ball circumference 202 |
| 104 | center of mass of head 32 |
| 106 | a-d, points delineating corner rectangular parallelopiped 74 |
| 108 | center of mass of portion 76 in corner rectangular paralleloped 74 |
| | AXES, LINES, SURFACES, AND ANGLES FIGS. 1-11 |
| 200 | horizontal ground surface |
| 202 | circumference of a golf ball |
| 204 | horizontal loft or z-axis through geometric center 100 parallel to length line 300 |
| 206 | vertical twist or y-axis through geometric center 100 |
| 208 | horizontal x-axis through geometric center 100 perpendicular to horizontal loft axis 204 and vertical twist axis 206 |
| 210 | partial circumference of a circle in a vertical plane perpendicular to length line 300 with horizontal loft axis 204 as center and length 318 as radius |
| 212 | partial circumference of a circle in a horizontal plane with vertical twist axis 206 as center and length 320 as radius |
| 214 | angle of tilt or loft variation of head 32 when a BALL as designated by circumference 202 is miss-struck a vertical length 314 off the preferred spot, here represented as geometric center 100 |
| 216 | angle of twist of head 32 when a ball as designated by circumference 202 is miss-struck a horizontal length 316 off the preferred spot, here represented as geometric center 100 |
| 218 | lightly dashed horizontal line representing extension of top 48 to extreme of toe 44 parallel with length line 300 |
| 220 | lightly dashed vertical line representing extension of extreme point of toe 44 parallel with height line 306 |
| 222 | lightly dashed horizontal line representing extreme point of toe 44 parallel with width line 312 |
| | DIMENSIONS, FIGS. 1-11 |
| | As a reminder, each of the following defdinitions assume that head 32 is soled on ground surface 200 in its normal position for addressing the ball. |
| 300 | horizontal length of head 32 between vertical projections of imaginary parallel planes that are perpendicular to the length line and placed at extremes of toe 44 and heel 46, respectively |
| 302 | half the length 300 of head 32 |
| 304 | one quarter the length 300 of head 32 |
| 306 | vertical height of head 32 between horizontal projections of imaginary parallel planes placed at extremes od top 48 excluding hosel 36 and sole 50 on ground surface 200, respectively |
| 308 | half the height 306 |
| 310 | one quarter the height 306 |
| 312 | horizontal width of head 32 between vertical projections of imaginary parallel planes from extreme toward ball striking surface 38 and extreme toward back 42 on a line perpendicular to 300 |
| 314 | vertical length the center 102 of a golf ball as designated by circumference 202 is miss-struck off the preferred ball striking spot here represented as the geometric center 100 |
| 316 | horizontal length the center 102 of a golf ball as designated by circumference 202 is miss-struck off the preferred ball striking spot here represented as the geometric center 100 |
| 318 | direct length from horizontal loft or z-axis 204 to a horizontal projection from center of mass 108 wherein the projected line is parallel with z-axis 204 |
| 320 | direct length form vertical twist or y-axis 206 to a vertical projection of center of mass 108 |
| | SCHEMATIC DIAGRAM FIG. 12 |
| 400 | near-clubhead with a cavity-back |
| 402 | toe |

-continued

| | |
|---|---|
| 404 | heel |
| 406 | horizontal facial edge |
| 408 | vertical facial edge |
| 410 | rear surface and interior wall of cavity |
| 412 | side wall of cavity |
| 414 | back of near-clubhead and exterior wall of cavity |
| 416 | vertical axis through geometric center of potential striking surface |
| 418 | horizontal axis through geometric center of potential strking surface parallel with length line 420 |
| 420 | length of near-clubhead |
| 422 | width of near-clubhead |
| 424 | height of near-clubhead |
| 426 | thickness of cavity wall |
| 428 | width of cavity wall |
| | SCHEMATIC DIAGRAM FIG. 13 |
| 450 | near-clubhead with a corner-back configuartion |
| 452 | toe |
| 454 | heel |
| 456 | horizontal facial edge |
| 458 | vertical facial edge |
| 460 | rear surface |
| 462 | upper toe weight |
| 463 | upper optimal edge of toe 452 |
| 464 | lower toe weight |
| 465 | lower optimal edge of toe 452 |
| 466 | upper heel weight |
| 467 | upper optimal edge od heel 454 |
| 468 | lower heel weight |
| 469 | lower optimal edge of heel 454 |
| 470 | vertical axis through geometric center of potential striking surface |
| 472 | horizontal axis through geometric center of potential striking surface parallel with length line 474 |
| 474 | length of near-clubhead |
| 476 | width of near-clubhead |
| 478 | height of near-clubhead |
| 480 | length of a weight |
| 482 | width of a weight |
| 484 | height of a weight |

DETAILED DESCRIPTION OF A PREFERRED EMBODIMENT

Figure 1:
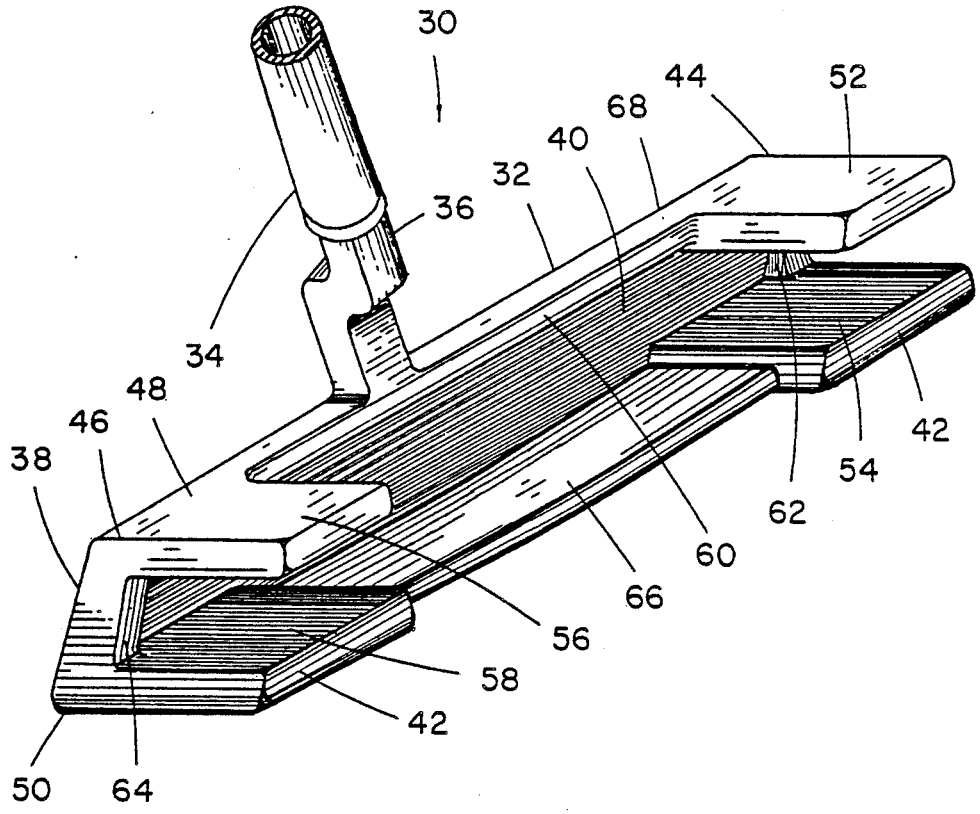
FIG. 1 is a perspective view of a putter head of the present invention.

In FIG. 1 number 30 refers to a golf club putter of the current invention. It has a head 32 to which a separate shaft 34 is adhesively affixed to hosel 36. On head 32 there is also a ball striking surface 38 which may be seen more directly in FIG. 2. Behind ball striking surface 38 are rear surface 40 and back 42. Head 32 also has a toe 44, a heel 46, a top 48, and a sole 50.

The objects of the current invention relate to the weight distribution at the corners of head 32. In this regard there are upper and lower tow weights 52 and 54, respectively, and upper and lower heel weights 56 and 58, respectively. The weights are all attached to rear surface 40.

The system of braces includes top brace 60, side braces 62 and 64, and extended sole 66 each attached to rear surface 40 and to the other components they support. Top brace 60 supports hosel 36 together with upper toe weight 52 and upper heel weight 56. Side brace 62 supports upper and lower toe weights 52 and 54, respectively, while side brace 64 provides a similar function for upper and lower heel weights 56 and 58, respectively. Extended sole 66 braces lower toe weight 54 and lower heel weight 58 and provides an extended medium to rest head 32 on a ground surface. As depicted, head 32 is a body casting 68.

Figure 2:
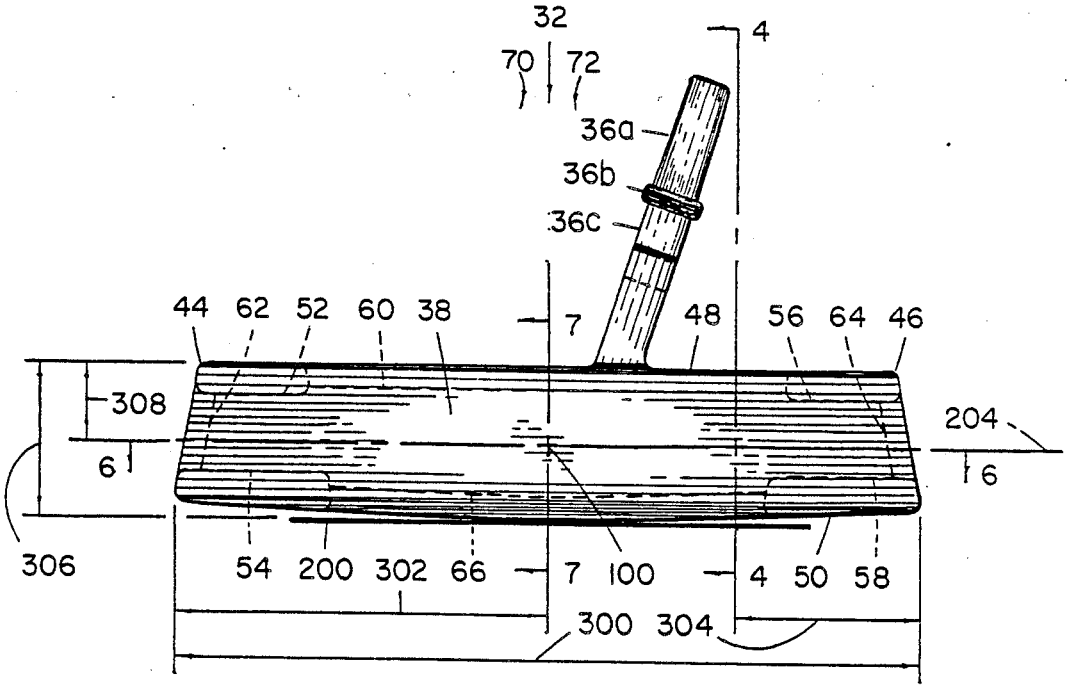
FIG. 2 is a front elevation view of the clubhead of FIG. 1.

With reference to the front elevation view of FIG. 2, putter head 32 is resting in its normal address position on ground surface 200. The drawing displays all hidden lines of components of head 32 behind ball striking surface 38. Shaft 34 is deleted in this and the following figures to illustrate fully the details of hosel 36. It consists of an arm 36*a* onto which shaft 34 may slide, a retaining collar 36*b*, and a neck 36*c* which joins top brace 60 and top 48.

Horizontal length 300 is the heel-to-toe length for head 32. Half-length 302 from the extreme of toe 44 is half the length 300. Half-length 302 defines the position of vertical cut-plane 7—7 which is perpendicular to both ground surface 200 and length line 300. Cut-plane 7—7 divides head 32 into a toe section 70 and a heel section 72. As seen in FIG. 2, hosel 36 accompanies the heel section 72. This will be true for almost all center-shafted putter heads such as head 32 and for all heel-shafted putters, irons, woods, and other utility clubs.

Too, half-length 302 sets one of the coordinates for geometric center 100 on ball striking surface 38. The other coordinate for geometric center 100 is half-height 308 as referenced from the top 48. It is half the vertical height 306 of head 22 which is measured from the extreme of top 48 excluding hosel 36 to the extreme of sole 50 on ground surface 200. In this embodiment the highest point of head 32 is seen to be anywhere on top 48 excluding the region where top 48 and neck 36*c* intersect. This will not be true generally. On most iron clubs, for example, the highest point on head 32 excluding hosel 36 will be near the toe end 44 of toe section 70.

Half-height 308 also defines the position for horizontal cut-plane 6—6 placed perpendicular to height line 306 and parallel with ground surface 200. As well, horizontal loft or z-axis 204 passes through geometric center 100. Z-axis 204 is shown as an extension of horizontal cut-plane 6—6, and it is parallel with length line 300.

Lastly in FIG. 2, there is vertical cut-plane 4—4 positioned perpendicular to length line 300 a quarter length 304 from the extreme of heel 46. Quarter-length 304 is just one-fourth the length 300 of head 32.

Figure 3:
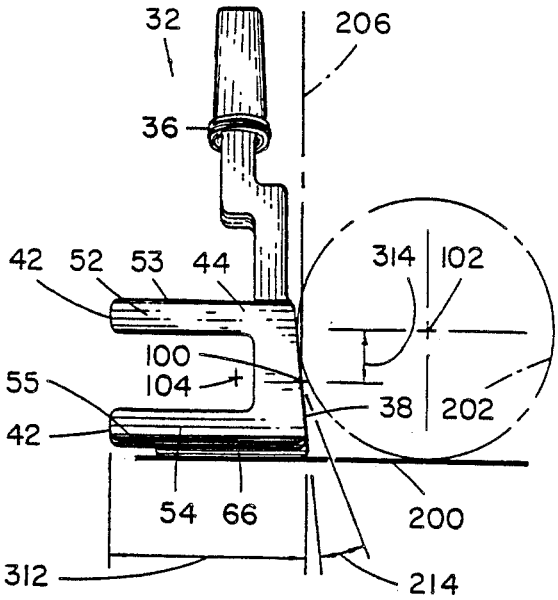
FIG. 3 is a side elevation view of the toe end of the clubhead of FIGS. 1 and 2.

FIG. 3 emphasizes the splitting of the weights 52 and 54 at the toe 44 of head 32. This perspective also provides a good view of the horizontal width 312 of head 32 in its normal address position as extended sole 66 rests on ground surface 200.

As seen in FIGS. 2 and 3, the dimensions 300, 306, and 312 form a mutually perpendicular set for head 32. For future reference, they also help define a rectangular parallelopiped or box inside of which head 32 less hosel 36 may fit. The rectangular parallelopiped for head 32 is formed with six planes, one perpendicular to each extremity of dimension lines 300. 306, and 312. It follows that cut-plane 7—7 of FIG. 2 divides this larger rectangular parallelopiped for head 32 into two smaller rectangular parallelopipeds of equal size, one each for the toe section 70 and the heel section 72.

Also shown in FIG. 3 are the geometric center 100 of ball striking surface 38 and the center of mass 104 of head 32. Vertical twist axis 206 through geometric center 100 is seen extending upward. In the figure, center of mass 104 is in a desirable location at about the same height as geometric center 100. Center of mass 104 may be most easily adjusted by changing the mass and dimensions of upper toe and heel weights 52 and 56, respectively, relative to lower toe and heel weights 54 and 58, respectively.

The relationship between ball striking surface 38 and its geometric center 100 relative to the circumference 202 of a golf ball and its center 102 is also shown in FIG. 3. The difference in vertical height 314 between centers 100 and 102 as well as the angle of loft variation 214 will be used in the explanation the operation of the invention.

Lastly in FIG. 3, upper optimal edge 53 and lower optimal edge 55 of the toe 44, respectively, are shown. A top view of these edges may be seen in FIG. 5. Optimal edges 53 and 55 are positioned toward the extreme of the toe near the top 48 and sole 50, respectively, and extend from ball striking surface 38 to back 42. They will be useful in the explanation of the operation and scope of the invention. Very briefly, they represent approximate lines along which the mass of upper toe weight 52 and lower toe weight 54 may be concentrated, respectively, to simultaneously enhance the moments of inertia and inertial efficiencies along horizontal loft axis 204 and vertical twist axis 206.

Figure 4:
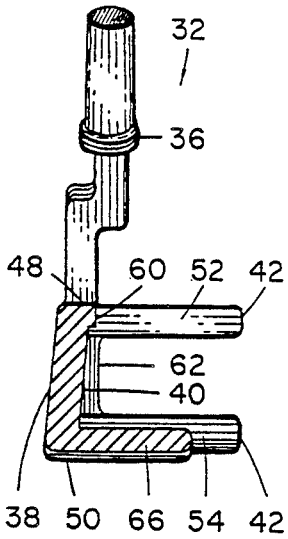
FIG. 4 is a cross-sectional side elevation view toward the tow end of the putter head of FIG. 2 as shown along the line 4—4.

With reference to the cross-sectional side view of head 32 toward toe end 44 of FIG. 4, structural details of the support system become apparent. Side brace 62 of toe 44 is seen joining rear surface 40 of ball striking surface 38. It helps support upper and lower toe weights 52 and 54, respectively, as they project toward back 42. At the top 48, top brace 60 also protrudes from rear surface 40 to help support hosel 36 and upper toe weight 52. At the sole 50, extended sole 66 joins rear surface 40 and serves as a brace for lower toe weight 54.

Figure 5:
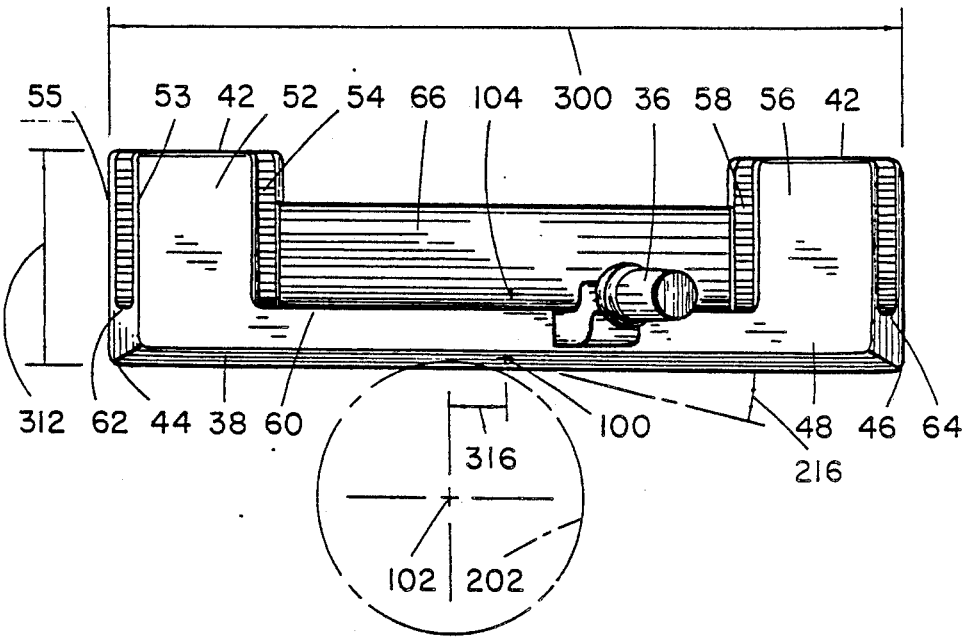
FIG. 5 is a top plan view of the clubhead of FIGS. 1–3.

The top plan view in FIG. 5 illustrates details of head 32 as would be seen by a right-handed golfer about to make a stroke. Notably, the size of each of the upper weights 52 and 56 is seen to be less than that of their lower counterparts 54 and 58, respectively. As suggested earlier, the decreased size of upper weights together with the mass in extended sole 66 helps to lower the center of mass 104. In FIG. 5, center of mass 104 is very slightly to the right of geometric center 100 due to the small contribution of hosel 36 in the heel section 70.

It can also be seen in FIG. 5 that top brace 60 and side braces 62 and 64, in addition to their support function, also lend an improved appearance for head 32. Alignment indicators, not shown, may be added anywhere on head 32, but most probably on top 48 and extended sole 66.

Figure 6:
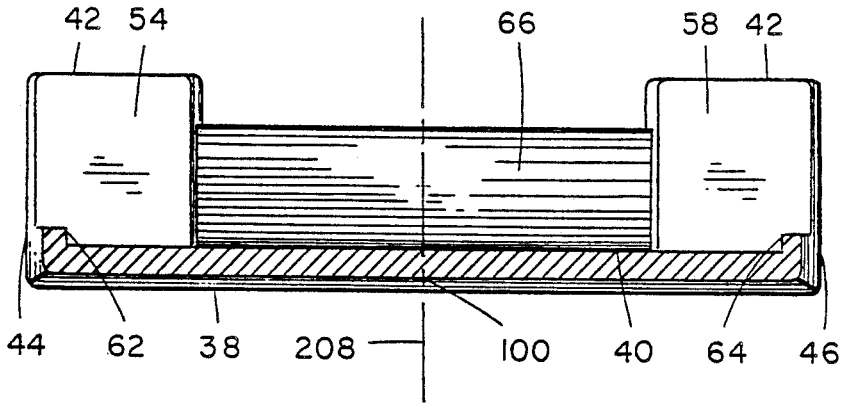
FIG. 6 is a top cross-sectional view of the putter head of FIG. 2 as shown along line 6—6.
Figure 7:
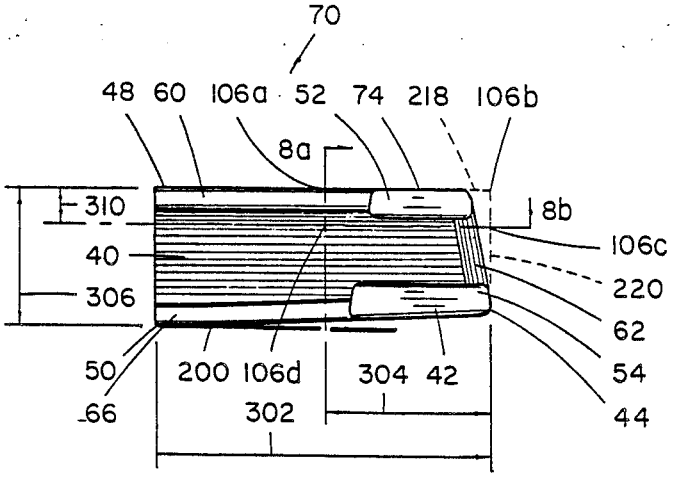
FIG. 7 is a rear elevation view of the toe section of the clubhead of FIG. 2 as shown along the line 7—7.

Lastly in FIG. 5, there is another view of key dimensions and relationships. These include horizontal length 300 from the extreme of toe 44 to the extreme of heel 46 as well as horizontal width 312 from extreme of ball striking surface 38 to the back 42. Also, the center 102 of golf ball circumference 202 is seen to be displaced a horizontal length 316 from geometric center 100 of ball striking surface 38. This, together with angle of twist 216, will be used in the explanation of the operation of the invention The top cross-sectional drawing of FIG. 6 illustrates the lower parts of toe and heel sections 70 and 72, respectively, as delineated by horizontal x-axis 208 through geometric center 100. The lower part of the toe section 70 runs to the left from axis 208 to toe 44 from ball striking surface 38 to back 42. Similarly, the lower part of the heel section 72 runs to the right from axis 208 to heel 46 from ball striking surface 38 to back 42. The unions of side braces 62 and 64 with rear surface 40 as well as the unions of extended sole 66 with lower toe weight 54 and and lower heel weight 58 are clearly illustrated FIG. 7 presents a rear elevation view of the entire toe section 70 correctly grounded on surface 200 as if the heel section 72 of head 32 were also in place. This view is helpful for defining the corner rectangular parallelopiped 74 of the upper toe 44 as shown in detail in FIGS. 8–11.

In FIG. 7 the height 306 of of golf clubhead 32 is again shown extending from top 48 to sole 50 on ground surface 200. Quarter-height 310 as referenced from the top 48 is just one-fourth the height 306. It defines the position of the horizontal cut-plane labeled 8*b*. Horizontal half-length 302 and quarter-length 304 of head 32 are referenced from the extreme of toe 44. Quarter-length 304 defines the position of the vertical cut-plane labeled 8*a* which is perpendicular to length lines 302 and 304.

The position of cut-planes 8*a* and 8*b* together with the top 48 and the extreme of the toe 44 lead to the position of the corner rectangular parallelopiped 74 as follows. The intersection of the line representing cut-plane 8*a* with the the line representing top 48 is labeled as the point 106*a*. In turn, the intersection of lightly dashed horizontal line 218 extending top 48 to the right with the lightly dashed vertical line 220 representing the extreme of toe 44 is labeled 106*b*. Similarly, the intersection of the line representing horizontal cut-plane 8*b* with the lightly dashed vertical line 220 is labeled 106*c*. Lastly, the intersection of the lines representing cut-planes 8*a* and 8*b* is labeled 106*d*.

In turn, the four points. 106*a*–106*d*, lead to planes of the corner rectangular parallelopiped 74 as follows. Point 106*a* and point 106*b* form a line through which exists a plane perpendicular to the height line 306 that is parallel with ground surface 200. There is a similar plane for the line joining points 106*c* and 106*d*. In turn, points 106*a* and 106*d* form a line through which exists a plane perpendicular to half-length line 302 that is also perpendicular to ground surface 200. There is a similar plane for the line joining points 106*b* and 106*c*. Finally, there are planes perpendicular to width line 312 at its respective extremes that are also perpendicular to ground surface 200. These two planes intersect the preceeding four planes at the extreme front of ball striking surface 38 and at the back 42 of head 32. The eight intersections of these six planes define the corner rectangular parallelopiped 74. It is seen that corner rectangular parallelopiped 74 has one eighth the volume of the rectangular parallelopiped for toe section 70 and one-sixteenth the volume of the rectangular parallelopiped for head 32 as previously defined.

In this preferred embodiment of head 32 it is noted that rectangular parallelopiped 74 contains all of upper toe weight 52. It also includes parts of ball striking surface 38, rear surface 40, top brace 60, and side brace 62 on toe 44. Too, corner rectangular parallelopiped 74 is not completely filled with the mass of head 32; it also contains some open space. However, the inclusion of parts other than weight member 52 and of some open space does serve to circumvent the otherwise awkward task of providing an exact delineation of upper toe weight 52'.

Figure 8:
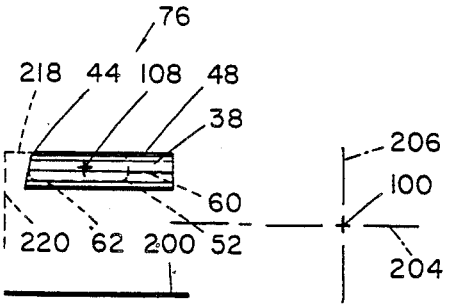
FIG. 8 is a front elevational view of the portion of the toe section of FIG. 7 in the corner rectangular parallelopiped of the upper toe as shown along lines **8*a*—8*b* of FIG. 7**.

Various perspectives of upper toe weight 52 and the aforementioned parts now defined in total as the portion 76 of the toe section 70 in corner rectangular parallelopiped 74 may be seen in FIGS. 8–11. FIG. 8 presents a front elevational view of portion 76 in an orientation similar to that for head 32 of FIG. 2. Lines 218 and 220 have been included to show that portion 76 has been rotated by 180° about twist axis 206 from the perspective shown in FIG. 7. In FIG. 8, the intersection of vertical twist axis 206 with horizontal loft axis 204 defines geometric center 100 shown in its correct position with respect to portion 76 and ground surface 200. A new detail in this figure is the representation of center of mass 108 of portion 76.

Figure 9:
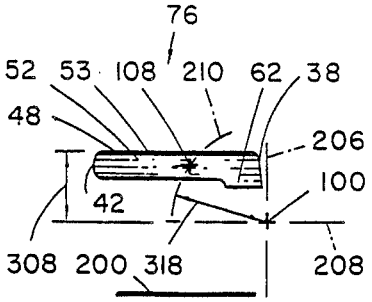
FIG. 9 is a side elevation view of the toe end of the portion of the toe section of FIG. 8.

FIG. 9 illustrates a side elevation view of the portion 76 in corner rectangular parallelopiped 74 of FIG. 8. The view is similar to that for head 32 shown in FIG. 3. A horizontal projection parallel with loft axis 204 of the center of mass 108 of portion 76 in parallelopiped 74 is shown in relation to ground surface 200, geometric center 100, horizontal x-axis 208, and vertical twist or y-axis 206.

In viewing FIG. 9, it is important to remember that geometric center 100, x-axis 208, and y-axis 206 are all behind portion 76. Accordingly, the direct length 318 shown in the diagram is actually a radius from horizontal loft or z-axis 204 to the partial circumference of a circle 210 through the projection of the center of mass 108 of portion 76.

However, horizontal loft or z-axis 204 is completely hidden because it is perpendicular to the plane of the page. Under these circumstances, it appears that one end of direct length line 318 is geomtric center 100. Actually, the vertical plane upon which partial circumference 210 and direct length 318 exist is perpendicular to horizontal loft or z-axis 204, and the center of mass 108 is projected perpendicularly onto it.

A similar set of comments apply for the half height 308 from the top 48 shown in FIG. 9. It appears in the diagram that the lower extremity of half-length 308 is geometric center 100. However, the lower extremity is actually a projection out of the plane of the page of horizontal loft or z-axis 204. The loft compression ratio is the ratio between direct length 318 and the the half-height 308, and it is one of the key ratios of the current invention. The significance of the loft compression ratio will be discussed after defining the twist compression ratio in conjunction with FIG. 11.

FIG. 10 is a cross-sectional side elevation view of the portion 76 of FIG. 8. The perspective is similar to that of FIG. 4 except that FIG. 10 is cut closer to toe 44 than FIG. 4. In FIG. 10 vertical twist axis 206, horizontal x axis 208, and geometric center 100 are again evident, but they are shown from the opposite direction of FIG. 9 in relation to portion 76. In the middle of the figure, center of mass 108 of portion 76 is shown directly below the top 48.

In FIG. 10, partial circumference 210 and direct length 318 are again seen in relation to half-height 308 and ground surface 200. Now, however, axes 206 and 208 together with geometric center 100 are in the front of portion 76.

For FIG. 11 portion 76 in corner rectangular parallelopiped 74 is presented from the perspective of the top 48 which is above horizontal loft or z-axis 204, horizontal x axis 208, and geometric center 100. The view is similar to that in FIG. 5.

The drawing also illustrates a vertical projection of center of mass 108, partial horizontal circumference 212 through the vertical projection of center of mass 108, and direct length 320 from vertical twist axis 206 to the vertical projection of center mass 108 of portion 76. Finally in FIG. 11 there is half length 302 referenced from the extreme of toe 44 represented by lightly dashed horizontal line 222. The twist compression ratio is the ratio between direct length 320 and half-length 302, and it is another of the key ratios of the current invention.

The data in TABLE I for a preferred embodiment similar to that shown in FIGS. 1–11 will further assist in reviewing and understanding the invention. Firstly, it is seen that the total mass of 311 grams for head 32 is well within the range for putters of the prior art. Similarly, its length 300 of 4.98 inches, its width 312 of 1.31 inches, and its height 306 of 1.00 inch are also values expected for a putter head.

However, the occupancy of 51.1% of the volume of corner rectangular parallelopiped 74 with mass is quite high considering the fact that head 32 is not a straight blade. Positioning mass in corner rectangular parallelopiped 74 tends to conflict with the desire for a low center of mass 104 for head 32. However, as seen in FIGS. 1–7 and as previously discussed the height of center of mass 104 may be controlled in part by distribution of mass between upper toe weight 52 and upper heel weight 56 relative to lower toe weight 54 and and lower heel weight 58, respectively.

This idea of a concentration of mass is further reinforced by comparing the mass of portion 76 in corner rectangular parallelopiped 74 to the total mass of toe section 70. The value of 19.9 percent obtained is well above that of 12.5 percent expected if head 32 were a straight blade.

In TABLE I the loft compression or the ratio of direct length 318 to half-height 308 pertains to an optimal moment of inertia and inertial efficiency about horizontal loft axis 204. In turn, the twist compression ratio, or the ratio of direct length 320 to half-length 302, pertains to an optimal moment of inertia about vertical twist axis 206. Qualitativel, the greater the ratio, the greater the moment of inertia and inertial efficiency about the respective axis. This assumes the mass in corner rectangular parallelopiped 74 remains constant.

TABLE I

Density, masses, dimensions, and critical ratios for a preferred embodiment similar to that in FIGS. 1–11.

| | | |
|---|---|---|
| Density of Be—Cu | 8.47 | g-cm$^3$ |
| Mass of head 32 with hosel 36 | 311 | g |
| Mass of hosel 36 | 20.6 | g |
| Mass of toe section 70 | 145 | g |
| Mass of portion 76 in corner rectangular parallelopiped 74 | 28.9 | g |
| Horizontal length 300 of head 32 | 4.98 | in |
| Half-length 302 | 2.49 | in |
| Quarter-length 304 | 1.24 | in |
| Vertical height 306 of head 32 | 1.00 | in |
| Half-height 308 | 0.500 | in |
| Quarter-height 310 | 0.250 | in |
| Horizontal width 312 of head 32 | 1.31 | in |
| Direct length 318 | 0.701 | in |
| Direct length 320 | 1.99 | in |
| Percentage of volume of corner rectangular parallelopiped 74 occupied with mass or portion 76 | 51.1 | % |
| Percentage of mass of portion 76 in parallelopiped 74 to total mass of toe section 70 | 19.9 | % |
| Loft compression ratio: direct length 318 to half-height 308 | 1.40 | |
| Twist compression ratio: direct length 320 to half-length 302 | 0.799 | |

The relationship between the two ratios may be explored as follows. Suppose initially that the width along width line 312 of head 32 is held constant. To increase the loft compression ratio, we must increase the direct length 318. Since width 312 is constant, this can be accomplished by decreasing the length 320 making upper toe weight 44 shorter in height and greater in length. In other words an increase in the loft compression ratio is gained at the expense of a decrease in the twist compression ratio. Hence, an increase in moment of inertia about the horizontal loft axis 204 is gained at the expense of a decrease in the moment of inertia about vertical twist axis 206. An exactly analogous argument may be presented to demonstrate that an increase in moment of inertia about vertical twist axis 206 is won at the expense of a decrease in the moment of inertia about horizontal loft axis 204.

Suppose that the restriction of a constant width for head 32 is removed, and its width is increased. It is readily seen that both direct lengths 318 and 320 could be enhanced. Accordingly, both of the compression ratios would increase. It is further noted that these ratios, individually or together, are enhanced by positioning the mass of the portion 76 more in the region of upper optimal edge 53 of the toe 44 as seen in FIGS. 9 and 11.

Lastly, increasing the mass of upper toe weight 52 or other components of portion 76 in rectangular parallelopiped 74 by removing additional mass from the center of toe section 70 also presents options for either or both axes 204 and 206 regarding moment of inertia and inertial efficiency. However, increasing this percentage is essentially independent of the preceeding considerations on length ratios which were made under the assumption of constant mass. The following section explores some of these qualitative notions from a more formal perspective.

OPERATION OF THE INVENTION

The dynamics will be explained with the schematic diagrams in FIGS. 12 and 13 with reference as necessary to the preferred embodiment in FIGS. 1–11. Necessary formulas for estimating moments of inertia that were developed in the parent application will be reviewed and modified for the purposes of this discussion. The algorithm Inertia presented in the parent will also be modified. The review and modifications are prompted by the fact that the discussion is now extended from one to two dimensions of inertial stability.

FIG. 12 presents a near-clubhead 400 in a cavity-back configuration. It has a toe 402 and a heel 404. The horizontal facial edge 406 and the vertical facial edge 408 define a flat potential ball striking surface which is hidden from view. The rear surface 410 and side walls 412 form the interior of a cavity behind which is back 414.

Vertical twist axis 416 is placed midway on horizontal facial edge 406 and horizontal loft axis 418 is placed midway along vertical facial edge 408. Near-clubhead 400 is generally characterized by a length 420, a width 422 and a height 424. More specifically, its cavity has a thickness 426 and a width 428.

FIG. 13 illustrates a near-clubhead 450 in a corner-back configuration. It has a toe 452 and a heel 454. The horizontal facial edge 456 and the vertical facial edge 458 define a flat potential ball striking surface which is hidden from view in this perspective. It is seen that four weights are attached to the rear surface 460. These include: upper toe weight 462, lower toe weight 464, upper heel weight 466, and lower heel weight 468.

Vertical twist axis 470 is placed midway along horizontal facial edge 456, and horizontal loft axis 472 is placed midway along vertical facial edge 458. Near-clubhead 450 is generally characterized by a length 474, a width 476 and a height 478. More specifically, each of its weights has a length 480, a width 482 and a height 484.

The potential efficacy of the near-clubheads in FIGS. 12 and 13 may be evaluted and compared using the concept of inertial efficiency. For the one-dimensional discussion of the the parent application, the inertial efficiency. E. was defined as the ratio of the actual experimental or computed moment of inertia, $I_a$, to its theoretical moment of inertia $I_t$.

$$E=I_a/I_t \quad \text{(EQN. 1).}$$

For practical cases, values of $I_a$ were determined about vertical heel-to toe axes through the geometric centers of the ball striking surfaces. In FIG. 12, this is y-axis 416, while in FIG. 13, it is y-axis 470. As stated earlier, in this extended two-dimensional discussion the original E is now designated as $E_y$ with the same subscript appended to the I's.

$$E_y=I_{a,y}/I_{t,y} \quad \text{(EQN. 1a).}$$

The definition of the top-to-bottom inertial efficiency, $E_z$ is similar to $E_y$.

$$E_z=I_{a,z}/I_{t,z} \quad \text{(EQN. 1b).}$$

Now, however, $I_{a,z}$ is determined about horizontal loft axes through the geometric centers of the ball striking surfaces. In FIG. 12, this is z-axis 418, while in FIG. 13, it is z-axis 472.

Following the original course set in the parent application, the development of expressions for the theoretical moments of inertia will again preceed the development of the expressions for the actual moments of inertia. The heel to-toe theoretical moment of inertia. $I_{t,y}$, was defined as the moment the clubhead would have if its mass, m, were divided in two with the half-masses placed at pinpoints a clubhead length, 1, apart and moment determined through a vertical axis at the midpoint. In the parent application it was also shown that:

$$I_t=\tfrac{1}{4}ml^2 \quad \text{(EQN. 2).}$$

Accordingly, EQN. 2 now becomes:

$$I_{t,y}=\tfrac{1}{4}ml^2 \quad \text{(EQN. 2a).}$$

In the examples in TABLE II, it is seen that both the cavity-back design in FIG. 12 and the corner-back design in FIG. 13 weigh 300 grams. Also, length 420 in FIG. 12 and length 474 in FIG. 13 are each 5.00 inches. Thus, from EQN. 2a each of the configurations has a theoretical moment of inertia. $I_{t,y}$, of 12.100 g-cm$^2$.

The top-to bottom theoretical moment of inertia. $I_{t,z}$, is the moment the clubhead would have its mass, m, were divided in two with the half-masses now placed at pinpoints a clubhead height, h, apart, and the moment determined through a horizontal axis at the midpoint.

$$I_{t,z}=\tfrac{1}{4}mh^2 \quad \text{(EQN. 2b).}$$

In the examples of TABLE II. it seen that both height 424 and height 478 are one (1) inch. Thus from EQN. 2*b*. each has theoretical moment of inertia, $I_{t,z}$, of 484 g-cm$^2$.

In the parent application, the actual moments of inertia. $I_a$'s, were determined both through approximation by classical formulae and by computer computations on mass-bits. The classical formulae, though less accurate than the computer algorithm, are retained because they helped guide the conceptual aspect of the invention. One such classical formula developed with reference to FIG. 10 of the parent application was:

$$I=\tfrac{1}{3}(m_1 l_2^2+m_2(l_2^2+l_2 l_3+l_3^2)) \quad \text{(EQN. 10)}$$

EQN. 10 was used for the determination of the moment of inertia about a vertical twist axis through the center of mass of a low density hollow bar with higher density weights inserted at both ends. In the expression. $m_1$ was the mass of the hollow bar, and $m_2$ was the mass of both of the weights. In turn, $l_2$ was the length from the center of mass to the end of the hollow bar, or it was the half-length of the bar. Finally, $l_3$, was the length from the center of mass to the closest point of one of the weights.

| Part A. Critical parameters for cavity-back system 400 in FIG. 12 | |
|---|---|
| 1. Length 420 | 5.000" |
| 2. Width 422 | 0.610" |
| 3. Height 424 | 1.000" |
| 4. Thickness 426 | 0.200" |
| 5. Width 428 | 0.322" |
| **Part B. Critical parameters for corner-back system 450 in FIG. 13** | |
| 1. Length 474 | 5.000" |
| 2. Width 476 | 1.289" |
| 3. Height 478 | 1.000" |
| 4. Length 480 | 0.900" |
| 5. Width 482 | 1.001" |
| 6. Height 484 | 0.200" |

With some caution as to interpretation and resultant error, EQN. 10 may be applied to systems such as represented in FIGS. 12 and 13. The first significant contribution: to the error is introduced by retaining the formula, but changing the reference axis from the center of mass to the twist axis while retaining length measurements of $l_2$ and $l_3$ parallel with the length of the head. The second significant contribution to the error is inherent in the use of the formula since, strictly speaking, it applies exactly only to infinitely thin bars. A more detailed discussion of these errors may be found in the parent application.

The first term in EQN. 10 may be applied to the potential striking face portions of FIGS. 12 and 13, and the second term to the cavity-back or corner back weight components. It is noted that the cavity-back system in FIG. 12 and the corner-back system in FIG. 13 may each have x possible weight components so that the moment of inertia for these may be taken separately and summed from n=1 to x to arrive at a total contribution. Accordingly, the revised formula for moments of inertia about the vertical y-axes becomes:

$$I_{a,y} = \tfrac{1}{3}\left(m_1 l_1^2 + \sum_{n=1}^{x} m_{2,n}(l_{2,n}^2 + l_{2,n}l_{3,n} + l_{3,n}^2)\right). \quad \text{(EQN. 10a)}$$

In EQN. 10*a*, $m_1$ is the mass of a potential striking face portion and $l_1$ is the half-length of a near-clubhead. In turn, $m_{2,n}$ is the mass of a single weight component. Finally, $l_{2,n}$ and $l_{3,n}$ are horizontal lengths parallel to the length line of the near-head from the twist axis to perpendicular projections of the most distant and closest points of a weight member, respectively.

From the examples in Parts A & B of TABLE II. it may be seen that the potential striking face portions of near-clubheads 400 and 450, respectively, are each 5.00 inches long, 0.288 inches wide, and 1.00 inch high. The widths are obtained by subtracting width 428 from width 422 in FIG. 12 and width 482 from width 476 in FIG. 13. It is noted that $l_1$ is just half of length 420 or 474 in TABLE II. Accordingly, given the density of Be-Cu at 8.47 g-cm$^3$, each potential striking portion has a mass of 200 grams and a first term contribution in EQN. 10*a* of 2687 g-cm$^2$.

The division of the weight member of the cavity-back in FIG. 12 into components may be performed arbitrarily. Two of the components are taken to be end portions having dimensions of length 426, width 428, and height 424 given in Part A of TABLE II. Each of these has a mass of 8.94 grams. For the length terms $l_2$ is 2.5 inches and $l_3$ is 2.3 inches. The two top and two bottom portions then have dimensions of half of length 420 minus length 426, width 428, and height 426. This gives a mass for each of 20.6 grams. For the length terms $l_2$ is 2.3 and $l_3$ is zero. Thus, the second or summation term in EQN. 10*a* is 1600 g-cm$^2$ giving a total inertia about y-axis 416 in FIG. 12 of 4290 g-cm$^2$ as seen in Part C of TABLE II. Combining this result with that for EQN. 2*a* above into EQN. 1*a* gives the accompanying inertial efficiency of 0.354.

As to the four weights of the corner-back design shown in FIG. 13, each has a length 480, a width 482 and a height 484 given in Part 8 of TABLE II. The mass of each is 25.0 grams and $l_2$ is 2.5 inches with $l_3$ being 1.6 inches. Thus, the summation term in EQN. 10*a* now becomes 2756 g-cm$^2$ which when combined with the striking face portion gives the results indicated in Part C of Table II for y-axis 470 of FIG. 13.

The formula for the actual moments of inertia about the horizontal z-axes 418 and 472 in FIGS. 12 and 13, respectively, is analogous to the previous expression:

$$I_{a,z} = \tfrac{1}{3}\left(m_1 h_1^2 + \sum_{n=1}^{x} m_{2,n}(h_{2,n}^2 + h_{2,n}h_{3,n} + h_{3,n}^2)\right). \quad \text{(EQN. 10b)}$$

In EQN. 10*b* the $m_1$ and $m_{2,n}$ terms are the same as those in EQN. 10*a*. Now, however, the $h_1$-term becomes half the height 424 or 478 in FIGS. 12 or 13, respectively. The $h_2$ and $h_3$ terms are the vertical lengths from a loft axis to horizontal projections of the most distant and nearest points of a weight member, respectively. The values shown in Table II. Part D for moments of inertia and inertial efficiencies along loft axes 418 and 472 were calculated with methods analogous to those used for Part C of the table.

The results in parentheses in Parts C and D of Table II have actual moments of inertia computed using the algorithm Inertia of the parent application. For moments about vertical twist axes, the algorithm may be described in the following two steps:

Set INERTIA-BIT to MASS-BIT×(LENGTH-BIT$^2$+WIDTH-BIT$^2$)

Set the total INERTIA to the sum of all possible INERTIA-BITs.

To apply the algorithm, a plane defined by the length and width lines of a near-clubhead is divided into 0.1-inch squares. A MASS-BIT is the mass of the near-clubhead in a rectangular parallelopiped through a 0.1-inch square with the height of the parallelopiped set parallel to the vertical twist axis. A LENGTH-BIT is a horizontal length parallel to the length line from a twist axis to a horizontal projection parallel to the width line from the center of a 0.1 inch square. A WIDTH-BIT is the length of the preceeding projection.

Modification of algorithm Inertia for computations about the horizontal loft axes is straightforward:

Set INERTIA-BIT to MASS-BIT×(HEIGHT-BIT$^2$+WIDTH-BIT$^2$)

Set the total INERTIA to the sum of all possible INERTIA-BITs.

Now, however, a plane defined by the height and width lines of a near-clubhead is divided into 0.1-inch squares. A MASS-BIT is the mass of the near-clubhead in a rectangular parallelopiped through such a 0.1 inch square with the length of the parallelopiped set parallel to the horizontal loft axis. A HEIGHT-BIT is the vertical height from a twist axis to a horizontal projection parallel to the width line from the center of a 0.1 inch square. A WIDTH-BIT is the length of the preceeding projection.

Two general conclusions may be drawn with regard to the results in Parts C & D of TABLE II. Firstly, the values for the corner-back design are superior along both sets of axes for both sets of values. Secondly, the mass-bit values are always greater than the corresponding formula values.

This second conclusion is generally expected because of the finer resolution on distance measurements from the respective axes to centers of mass. In other words mass-bit lengths are equal to or larger than the corresponding formula lengths, and they yield the more accurate results.

In Part C of Table II. it is seen that the divergence between the mass-bit and formula values is small, and well within the 20 percent range expected. However, as seen in Part D of Table II the divergence is much greater than that percentage for results along the horizontal loft axes 418 and 472. An understanding of this phenomenon is straightforward. The heights 424 and 478 of near clubheads 400 and 450, respectively, in TABLE 11 are only a fraction of the lengths 420 and 474. Accordingly, the relative distance errors with the formulae become greater when the lesser heights are involved.

This same phenomenon leads to an inertial efficiency of 1.45 about the loft axis 472 of the corner-back near-clubhead 450. The argument could be be made that the value for a true efficiency should not exceed 1.00. To retain the concepts and methods as defined, the inertial efficiency may be regarded instead as an inertial evaluator or coefficient.

The mass-bit results in Parts C & D are particularly compelling regarding the issue of the superiority of the corner-back over the cavity-back design. The moment of inertia across the vertical twist axis 470 is 33 percent larger for the corner-back near-head. It is 88 percent larger for the horizontal loft axis 472. The large gain in stabilization about the twist axis was affirmative, but the far greater gain about the horizontal loft axis was surprising.

There is the question that if the inertial efficiency can become greater than 1.00 and if the computer results are far more sensitive and accurate than the calculations by formulae, then why bother with the formulae at all? The answer is straightforward: the detailed interpretation of the theory and formulae lead to the invention.

For the two dimensional case, the idea of inertial efficiency, as expressed in EQN. 1*a*, suggests dividing the mass of a clubhead in two and then placing the halves as pinpoints at the heel and toe, respectively. In turn, EQN. 1*b* suggests dividing those pinpoints in two and placing two of the pinpoints at top and bottom of the toe, respectively, and the other two in similar positions on the heel.

Since it would be impossible to divide, for example, a 300 gram clubhead into four pinpoints in the first place, and since it would be impossible to play golf wit them in the second place, then EQNS. 10*a* & 10*b* come into play. It is seen in EQN. 10*a* that the moment of inertia can be optimized by reducing $m_1$, enhancing the $m_{2,n}$'s, and having the $l_{3,n}$'s approach their respective $l_{2,n}$'s in magnitude. All of this means: (i) reduce the mass of the striking face as much as possible: (ii) increase the mass of the weights accordingly; and (iii) expand the mass of the weights onto planes perpendicular to the length line of the clubhead at the heel and toe, respectively. In FIG. 13, these planes are defined by optimal edges 463 and 465 at the toe 452 and by optimal edges 467 and 469 at the heel 454.

The analysis of EQN. 10b is similar with the only difference being that the mass of the weights is expanded onto planes perpendicular to the height line at the top and bottom of the clubhead, respectively. In FIG. 13, these planes are defined by optimal edges 463 and 467 and by optimal edges 465 and 469, respectively.

Thus the optimal edges 463. 465. 467, and 469 actually represent the intersection of these two sets of planes. Within the framework that the problem has been presented, these edges are the solution for simultaneously optimal moments of inertia along vertical twist axis 470 and horizontal loft axis 472. Since, the mass of a weight, cannot itself be compressed to an edge, the critical edges are expanded into larger geometric configurations extending from the corners of a clubhead. In FIG. 13, these larger geometric configurations are rectangular parallelopipeds of the weights 462. 464, 466, and 468.

As see in FIGS. 3, 5, 9, and 11, the optimal edges for an actual clubhead 32 need not be placed exactly in the same position they are for near-clubhead 450. In the aforementioned figures, for example, it is seen that optimal edge 53 is positioned at the extreme of the top 48, but it is not positioned at the extreme of toe 44. Similarly optimal edge 55 is positioned at the extreme of the toe 44, but it is not positioned at the extreme of the bottom or sole 50. Accordingly, it can be said that optimal edges 53 and 55 are positioned approximately parallel to the width line 312 toward the extreme of the toe 44 and toward the extremes of the top 48 and sole 50, respectively. Alternatively, optimal edges 53 and 55 are positioned approximately parallel to the width line 312 toward the extreme upper and lower corners of toe 44, respectively.

In the previous section on the detailed description of a clubhead 32 it was suggested that when the mass of a weight was held constant as its width was increased the moment inertia could be increased along both the horizontal loft and vertical twist axes. These possibilities are now more fully explored with near-clubhead 450.

The moments of inertia along axes 470 and 472 of FIG. 13 may be simultaneously increased by extending the width 482 and decreasing the length 480 of the weights 462, 464, 466, and 468. Too, both moments may be enhanced by extending the width 482 and decreasing the height 484 of the preceeding weights. Finally, they may be both enlarged by extending the width 482 and decreasing both the length 480 and the height 484 simultaneously. However, it is necessary to remember that the action of increasing the width 482 of a weight has the accompanying effects of moving the center of mass back away from the potential ball striking surface and of possibly requiring more bracing.

Thus, in the design of clubheads with corner-back configurations there are various trade-offs to be considered. These include: how much mass separation between striking face and weights is feasible in the first instance: which axis, vertical twist axis 470 or horizontal loft axis 472, is of primary concern in the second: how high and how far back the center of mass should be in the third; and the requirement for structural support in the fourth. In general terms, it will be seen that one contribution of the corner-back configuration of this invention is to open up all of these various options. Among these, the enhanced stability along loft axis 472 is of special concern.

Since the golf clubhead 32 of the preferred embodiment as illustrated in FIGS. 1–11 is similar in structure to near-clubhead 450 of FIG. 13, it is readily apparent that the clubhead 32 also possesses superior moments of inertia along horizontal loft axis 204 and vertical twist axis 206. With reference to FIG. 3 it will be seen that when the center 102 of a ball as represented by circumference 202 is miss-struck a vertical length 314 off the preferred spot here represented as the geometric center 100 of the ball striking face 38, the angle of tilt 214 of head 32 will tend to be diminished as a result of the improved moment of inertia along horizontal loft axis 204. With reference to FIG. 5 it will be seen that when center 102 is miss-struck a horizontal length 316 off the geometric center 100, the angle of twist 216 of head 32 will also tend to be diminished, this time as a result of the improved moment of inertia long vertical twist axis 206. Of course, when a ball is simultaneously miss-struck a vertical length 314 and horizontal length 316, then the angle of tilt 214 and the angle of twist 216 will both tend to be diminished for the reasons given above, respectively

SCOPE, RAMIFICATIONS, AND CONCLUSIONS

Thus, it may be recognized that the clubhead 32 in the corner-back configuration of the present invention is a general model for golf clubheads that are stabilized with regard to loft variations and twisting when a ball is struck. As the invention is primarily concerned with relative mass distribution as well as certain length ratios, a suitable clubhead can be made for any person of any size and age.

While my above description contains many specificities, these should not be construed as limitations of the scope of the invention, but rather as exemplication of one preferred embodiment thereof. Many other variations are possible. Indeed, it will be readily seen by persons familiar with the art and science of designing golf clubs that the principles, practices, variations, modifications, and equivalents of the preferred embodiment of this invention may be readily applied to all classes of clubs including as well other monofacial putters, bifacial putters, woods, irons, and utility clubs as included within the spirit and scope of the appended claims.

While parameters such as hosel position, loft, total weight, shaft length, and the grooves in the clubface may change from clubhead to clubhead, the appended claims do not relate to these parameters. Instead they relate to the distribution of mass in the toe section of the clubhead and certain design ratios thereto. The distribution of mass and design ratios are common to all clubheads in the corner-back configuration.

Accordingly, the position of hosel 36 is not critical to this invention. Head 32 may be center-shafted as illustrated in FIGS. 1–5; or it may be heel-shafted; or less likely, in the case of putters, it may even be toe-shafted. If a part or all of hosel 36 resides in the toe section 70, then its proportional contribution to the mass should be included in that section. In fact hosel 36 is optional as other known means such as a simple hole in head 32 would do to attach a shaft 34 in some circumstances.

It may be found instructive to take this a step further and consider how the design of golf club putter 30 might be approximately modified so as to make it into an iron or wood. As may be seen especially in FIG. 2, ball striking surface 38 is trapezoidal in shape with the length across top 48 being slightly less than that across sole 50. For an iron or wood, these lengths might be reversed so that the length across top 48 would be greater than that across sole 50.

For both the iron and wood, hosel 36 would be strengthened and moved to the extreme region of heel 46. In the case of the iron, hosel 36 would most likely be positioned at the front in the region of ball striking surface 38. For the wood, hosel 36 might be positioned in the region between the ball striking surface 38 and the back 42. Other changes would be similar in kind for both the iron and wood as follows.

As is well known in the trade, the total mass of golf clubs is relatively constant throughout a set including putter, irons and woods. Accordingly as the length and mass of the shafts increase in progressing from putter, irons, and woods the mass of the clubheads decrease proportionally.

Thus, the iron or wood head would be made with less mass by an amount approximately in proportion to the increase in mass of the shaft for the iron or wood over that for the golf putter 30. Also, since the clubhead is now heel-shafted some mass would also be re-arranged between the toe weights 52 and 54 and the heel weights 56 and 58 so that there was something approximating a 60–40 percent split between the masses of the toe section 70 and the heel section 72. The loft of clubhead 32 could be increased and appropriate grooves added to ball striking surface 38. It is seen that none of these changes would necessarily alter the basic distribution of mass and design ratios for the toe section 70 that define the corner-back configuration. Therefore, these and any other modifications could be carried out in a relatively straightforward fashion.

The preceeding considerations imply that traditionally-shaped wood and iron clubs are beyond the scope of this invention. This includes woods made of persimmon, maple, or laminated materials as constructed on a lathe. It also includes modern hollow-back irons and woods made by body casting in traditional shapes.

Body casting with a metal is considered to be a highly preferred method of constructing a strong unitary version of my invention. However, any manufacturing process and any materials or combination of materials of any appropriate density capable of providing the desired combination of strength, durability, mass distribution, and design rations for a clubhead in the corner-back configuration would be considered acceptable.

Similarly, the weights 52, 54, 56, and 58 could be joined to head 32 by means other than direct union with rear surface 40. As another acceptable possibility they could be separated entirely from rear surface 40, top brace 60 and side braces 62 and 64, and affixed to head 32 in similar positions with a separate system of braces.

The absolute data on masses and dimensions for head 32 as set forth in TABLE I are not critical to the invention. For a small child's clubhead they might be less. For a large adult's clubhead they might be more. It has also been shown that the corner-back design may have variability in the distribution of mass of mass between hosel 36, ball striking surface 38, and weights 52. 54, 56, and 58. However, the values of the percentages and ratios set forth in TABLE I are of importance because they define the ranges of the ratios set forth in the appended claims Similarly, the data in TABLE II should be regarded only as a means to illustrate the theory as set forth in EQNS. 1–10*b* and the algorithms. This information is included with the hope that it will provide understanding and help to spur future developments. It also supports the key notion of this invention regarding moments of inertia and inertial theory. That key idea is the inherent advantage of the corner-back over the cavity back configuration along both the horizontal loft axis and the vertical twist axis.

We do not wish to be bound by the path of the development of the theory or the resultant theory itself beyond that necessary for the appended claims. Other starting points and other pathways, theoretical or purely empirical, could lead to a similar invention. In this case, the theory is regarded as an essentially separate entity that guided the definition of several empirical design ratios that are helpful in describing the invention. This empirical realm of ratios covers key masses and lengths.

In the preferred embodiment of FIGS. 1–11, upper toe weight 52 is entirely within the bounds of corner rectangular parallelopiped 74. Clearly this is the preferred position of upper toe weight 52 for a clubhead 32 in the corner-back configuration where both the horizontal loft axis 204 and the vertical twist axis 206 are inertially stabilized. Nontheless, there are at least three reasons for suggesting that some of upper toe weight 52 may be outside corner rectangular parallelopiped 74 while the invention as set forth in the appended claims retains its essential spirit.

A first reason has to do with the difficult and partially arbitrary task of delineating interconnected components. For example, in the preferred embodiment upper toe weight 52 is joined to side brace 62. In addition to being a supporting member, isn't side brace 62 also a toe weight? Where does side brace 62 end exactly, and where does upper toe weight 52 begin exactly? Since the answers to such questions, require painstaking deliberation, it seems better to allow that some of upper toe weight 52 may reside outside of corner rectangular parallelopiped 74.

A second reason has to do with purely technical factors. One such factor might involve lowering of the center of mass 104 of the entire clubhead 32. Accordingly, upper toe weight 52 might be moved down more than usual toward sole 50. As another possible factor he or she may wish to retain the essential features of the corner-back design, but to optimize one or the other of the moments to an unusually high degree while retaining a constant width for upper toe weight 52. If it were desired, for example, to have a very high moment about the vertical twist axis 206, this would require squeezing the mass of upper toe weight 52 more toward the toe 44, so that the height of upper toe weight 44 might become greater than the height of corner rectangular parallelopiped 74. As still another possible factor, the designer might be so successful in separating mass that the volume of upper toe weight 52 might be too great to fit into corner parallelopiped 74 at the specified width 312.

A third reason that some of upper toe weight 52 may breech the boundaries of corner rectangular parallelopiped 74 has to do with the possibilities for extending upper toe weight 52 in certain directions. In the parent application, for example, it was implied in one of the figures (FIG. 5) that toe weight (40) could be extended along a partial horizontal circumference of a circle (207) with vertical twist axis (206) as its center. Under these circumstances, the toe weight (40) might even be made to be partially cylindrical in shape to join, say heel weight (42). also partially cylindrical in shape. Here the numerals in parentheses refer to parts in the parent application.

In this work a similar extension would imply that upper toe weight 52 be positioned along the partial horizontal circumference 212 toward heel 46 as seen in FIG. 11. Indeed, some extension along this line does seem reasonable. However, upper toe weight 52 might also be made to join upper heel weight 56 forming a configuration resembling a half-washer in a horizontal plane behind rear surface 40. Such an extreme breech of corner rectangular parallelopiped 74 would not be considered an embodiment of the present invention.

This raises the question of why a large extension along partial horizontal circumference (207) in the parent work would lead to an embodiment of that invention, and why a similarly large extension along partial horizontal circumference 212 of this work would not lead to a preferred embodiment? The answer has to do with the fact that the parent effort was concerned exclusively with the task of creating an optimal moment of inertia about one axis, the vertical twist axis (206). This work, on the other hand, has to do with creating optimal moments of inertia about both the horizontal loft axis 204 and the vertical twist axis 206 simultaneously. In this regard it is seen FIGS. 3 & 5 and FIG. 13, respectively, that optimal edge 53 for upper toe weight 52 and optimal edge 463 for upper toe weight 462 are approximately straight, and not curved like partial horizontal circumference 212.

However, there is an important exception for the simultaneous solution as represented by optimal edge 53 in FIGS. 3 & 5 and by optimal edge 463 in FIG. 13. It has to do with partial vertical circumference 210 as seen in FIGS. 9 and 10. This line implies that upper toe weight 52 may be extended downward at the back 42 perhaps joining lower toe weight 54. As viewed from FIGS. 3 and 4, such a union might be linearly up down in the region of the back 42. Or the union might partially cylindrical in shape forming a half-washer in the vertical plane. In both cases optimal edges 53 and 55 could be joined toward the back 42.

The question now becomes why is a configuration with a half-washer in a vertical plane a reasonable embodiment and a configuration with a half-washer in the horizontal plane not a very reasonable embodiment? The answer is really one of degrees. The ideal solution is felt to represented in FIGS. 1–11 and 13. In contrast to this, a configuration with a large half-washer in the horizontal plane is an entirely different species with regard to length and mass considerations as referenced along the axes 204 and 206. Conversely, a configuration with a small half washer in the vertical plane is the same species with a minor extension. This also implies that something less than a wholesale extension of upper toe weight 52 in the horizontal plane would be reasonable.

In review, there are at least three reasons why upper toe weight 52 may exceed corner rectangular parallelopiped 74. They are: (i) the difficulty of distinguishing between upper toe weight 52 and the components of head 32 attached to it; (ii) technical factors such as positioning the center of mass 104, favoring one of the axes, 204 or 206, over the other, or separating mass to a very high degree; and (iii) a modest extension horizontally toward heel 46 or vertically toward sole 50 in the region of the back 42. Similarly, any one, any combination of these, or other reasons may be offered to justify why optimal edges 53 and 55 need not be positioned exactly at the extreme of upper and lower toe 44, respectively. Too, the edges need not be slavishly linear.

It is also true that while upper toe weight 52 is approximately rectangular corresponding to the shape of corner rectangular parallelopiped 74, this need not be the case in general. Indeed, upper toe weight 52 may be of any shape which tends to lead to a significant concentration of mass extending behind the striking face in the extreme region of the upper toe 44 and to enhanced moments of inertia and inertial efficiencies along both the horizontal loft axis 204 and the vertical twist axis 206. This also applies to lower toe weight 54.

The width of extended sole 66 is not critical to this invention. It may be narrower or even deleted altogether. Conversely, its width may be increased so that it forms a part or all of back 42.

If the width of extended sole 66 were increased so that its rearmost extension was colinear with the rearmost extension of lower toe weight 54 coinciding with the back 42 of head 32, then the problem of distinguishability would again arise. In this case it would become more difficult to decipher lower toe weight 54 from extended sole 66. Since a similar problem exists with upper toe weight 52, the entire problem of distinguishability and its solutions are reviewed for purposes of understanding the underlying structure of the appended claims.

The two-fold problem is this: (i) it may be difficult to separate in detail upper toe weight 52 from rear surface 40, top brace 60, and side brace 62; and similarly (ii) it may be difficult to separate in detail lower toe weight 54 from rear surface 40, side brace 62, and extended sole 66.

Two, essentially separate, sets of tactics may be employed to overcome the difficulties arising with distinguishability. The first set employs the concept that corner rectangular parallelopiped 74 is a reasonably correct position for upper toe weight 52, and any and all mass within the region of space defined by rectangular parallelopiped 74 effectively becomes toe weight 52. More generally, portion 76 of corner rectangular parallelopiped 74 in toe section 70 becomes a concentration of mass which extends as the substantially discrete entity of toe weight 52 from behind the ball striking surface 38 toward the back 42.

The second set of tactics uses optimal edges such as 53 and 55 of the upper and lower toe 44, respectively, as seen in FIGS. 3 and 5. Any and all concentrations of mass positioned close to these edges effectively become upper and lower toe weights 52 and 54, respectively. However, only the concentration of mass that is near upper optimal edge 53 really needs to be viewed as the subtantially discrete entity as toe weight 52. Also, as we have seen, the optimal edges need not be perfectly linear, just generally so.

The appended claims will also be found to contain reference to the loft and twist compression ratios pertaining to portion 76 of corner rectangular parallelopiped 74. By way of review the loft compression ratio has as its numerator the direct length 318 between the horizontal loft axis 204 to a horizontal projection from the center of mass 108 of portion 76 wherein the projected line is parallel with axis 204. The denominator is the half-height 308 of the head 32. The twist compression ratio has as its numerator the direct length 320 from vertical twist axis 206 to a vertical projection of the center of mass 108 of portion 76. Its denominator is half-length 302 of head 32

Accordingly, the scope of the invention should not be determined by the embodiment illustrated, but by the appended claims and their legal equivalents.

The following material provides some alternative descriptions of head 32 as depicted in the FIGS. 1-11.

From FIGS. 1 and 4 the combination including ball striking surface 38 toward the front and external rear surface 40 toward the back 42 may be regarded as a striking means to strike a golf ball.

In FIG. 2 the toe section 70 is seen to extend half the length 300, or a half-length 302, from the extreme of the toe 44 toward the heel 46 to a central boundary defined by cut-plane 7—7 which is positioned perpendicularly to the length line 300 of clubhead 32.

Since weights 52, 54, 56, and 58 are all bound to clubhead 32, they may be regarded as head weights and taken cumulatively as a head weight means serving as inertial weight for head 32.

Similarly in FIG. 2, toe weights 52 and 54 reside in toe section 70. Accordingly, they can be taken cumulatively as a toe weight means including at least one toe weight of the portion of the head weight means in the toe section 70 and serving as inertial weight for the toe section 70. This may be taken a step further to a configuration for toe section 70. Accordingly, adjacent the rear surface 40, upper toe weight 52 and lower tow weight 54 may be regarded to be first and second substantial percentages of the toe weight means or as an upper concentration of mass and a lower concentration of mass adjacent the top 48 and the toe 44 and adjacent the sole 50 and toe 44, respectively, with each concentration extending rearward from adjacent the rear surface 40 of the striking means toward the back 42 and between the extreme of the toe 44 and the central boundary defined by cut-plane 7—7.

Furthermore, the upper concentration of mass as upper toe weight 52, from limits between the extreme of the toe 44 and the central boundary defined by cut-plane 7—7, extends rearward in a compact form. In this manner, the central extent of the upper concentration as upper toe weight toward the central boundary defined by cut-plane 7—7, as viewed from the top 48 in FIG. 5, is generally less half the length 300, or half-length 302, of the clubhead 32 from the extreme of the toe 44. Too, the upper concentration as upper toe weight 52 extends rearward substantially separated from the lower concentration as lower toe weight 54 along the outside toward the extreme of the toe 44 as seen in FIG. 3, along the inside toward the central boundary defined by cut-plane 7—7 as seen in FIG. 4, and along the bottom side toward the sole 50 as seen in both FIGS. 3 and 4.

As shown in greater detail, particularly in FIGS. 3 and 4, the upper concentration of mass as upper toe weight 52 is attached directly to the external rear surface 40 of the striking means, and extends rearward therefrom generally separated from the other components of clubhead 32 along the outside toward the extreme of the toe 44, along the inside toward the central boundary defined by cut-plane 7—7, along the topside toward the top 48, and along the bottom side toward the sole 50 of the upper concentration.

In FIGS. 2 and 4, upper toe weight 52 is seen to have a length that is approximately one-sixth the length 300, a width that is approximately three-fourths the width 312, and a height that is approximately one-fifth the height 306 of head 32 as it extends rearward from rear surface 40 to back 42. Similarly in FIGS. 2 through 4, the length of upper toe weight 52 extending rearward is seen to be generally greater than its height. Too, in FIG. 4 the width of upper toe weight 52 as manifested from rear surface 40 to back 42 is seen to be generally greater than its height as manifested from top 48 to the upper extent of side brace 62.

Accordingly, the length, width, and height of the upper concentration of mass extending rearward as upper toe weight 52 are generally between about one-twentieth to one-third the length 300 of head of the clubhead 32, one-tenth to nine-tenths the width 312 of clubhead 32, and one-twentieth to one-third the height 306 of clubhead 32, respectively. In turn, the width of the upper concentration of mass extending rearward from external rear surface 40 to back 42 as upper toe weight 52 is generally at least half the width 312 of the clubhead 32. Finally, the length and the width of the upper concentration of mass extending rearward from external rear surface 40 to back 42 as upper toe weight 52 are both generally greater than the height of this upper concentration.

As seen in FIGS. 2, 3, and 5, clubhead 32 may be viewed as comprising an upper optimal edge 53 that is approximately parallel tot he width line 312 of the clubhead 32 positioned within about one-fourth the height 306 of the clubhead from the extreme of the to- 48 and within about one-fourth the length 300 of the clubhead from the extreme of the toe 44, whereby the portion of the upper concentration as upper toe weight 52 adjacent the top 48 and the toe 44 generally extends rearward along the upper optimal edge 53. Clubhead 32 also comprises a lower optimal edge 55 approximately parallel to the width line 312 of the clubhead 32 positioned within about one-fourth the height 306 of clubhead 32 from the extreme of the sole 50 and within about one-fourth the length 300 of the clubhead from the extreme of toe 44, whereby the portion of the lower concentration as lower toe weight 54 adjacent the sole 50 and the toe 44 generally extends rearward along the lower optimal edge 55.

As an alternative to the optimal edges, FIG. 5 also shows that the far extent toward the toe 44 of the upper concentration of mass as toe weight 52 and the far extent toward the toe 44 of the lower concentration of mass as toe weight 54 are each generally positioned within about one-fourth the length 300, or quarter-length 304, of clubhead 32 from the extreme of the toe 44. Similarly, FIG. 2 shows that the upper extent of the upper concentration of mass as toe weight 52 and the lower extent of the lower concentration of mass as toe weight 54 are generally positioned within about one-fourth the height 306, or a quarter-height 310, of the clubhead 32 from the extremes of the top 48 and sole 50 of the clubhead 32, respectively.

In FIGS. 1-5 and 7, the configuration of toe section 70 may be described qualitatively in terms of a series of four local widths. There is a generally minimal first local width approaching the width of the striking means adjacent the top 48 between the central boundary as cut-plane 7—7 and the upper concentration as upper toe weight 52. In fact, as seen particularly in FIG. 4, the width in this region is generally that of the striking means between ball striking surface 38 and rear surface 40 except for the partial contribution of top brace 60. Next, there is a generally maximal second local width of the toe section 70 due to the upper concentration as upper toe weight 52 extending rearward adjacent the top 48 and toe 44. This maximal second local width runs from ball striking surface 38 to back 42 approximately adjacent the top 48.

There follows a generally third local width approaching the width of the striking means due to the generally open space between the upper concentration as upper toe weight 52 and the lower concentration as lower toe width 54 due to the generally open space between these upper and lower concentrations adjacent the the 44. Once again, the width in this region is generally that of striking means between ball striking surface 38 and rear surface 40 except for the small partial contribution of side brace 62. Finally, there is a generally maximal fourth local width due to the rearward extension of the lower concentration as lower toe weight 54 adjacent the sole 50 and the toe 44. This maximal fourth local widths runs from ball striking surface 38 to back 42 approximately adjacent the sole 50.

Too, the maximal second local width is generally greater than each of the minimal first and third local widths, and the maximal fourth local width is also generally greater than the minimal third local width. More specifically, the maximal second local width is generally greater than each of the minimal first and third local widths by a factor of at least two.

As an alternative to corner rectangular parallelopiped 74 of the toe section 70 in FIG. 7, it may be said that the upper corner portion 76 of the toe section 70 spans one-fourth the length 300, or quarter length 304, of clubhead 32 from the extreme of the toe 44 toward the central boundary defined by cut-plane 7—7 to another vertical cut-plane **8*a* positioned perpendicularly to the length line 300 of clubhead 32. The upper corner portion 76 of the toe section 70 also spans one-fourth the height 306, or quarter-height 310, from the extreme of the top 48 toward the sole 50 to a horizontal cut-plane 8*b*. In FIG. 7–11, it is seen that upper corner portion 76 generally contains the upper concentration of mass as upper toe weight 52. Too, portion 76 also includes parts of ball striking surface 38, rear surface 40, top brace 60, and e brace 62 on toe 44**.

Under these circumstances, the loft and twist compression ratios as illustrated in FIGS. 8–11 and as previously discussed pertain to upper corner portion 76 along as well as to upper corner portion 76 in corner parallelopiped 74. It is seen in TABLE I that the loft compression ratios of the upper corner portion 76 of toe section 70 is greater than about 1.0; and the twist compression ratio of upper corner portion 76 is greater than about 0.75.

In FIGS. 1–3 and 5, clubhead 32 has been described as a body casting. It is also apparent from these figures that clubhead 32 is a single unit or unitary casting. Too, TABLE I indicates that it may be made of a metal like beryllium-copper. Hence, clubhead 32 is a unitary metallic casting.

What is claimed is:

1. A golf clubhead comprising:

a. a front together with a back, a top, a sole, a heel, and a toe;

b. a striking means to strike a ball including a ball striking surface toward said front and an external rear surface toward said back;

c. a fastening means to affix a shaft;

d. a head weight means comprising at least one head weight as inertial weight for said clubhead, and a binding means to attach said head weight means to said clubhead;

e. a toe section of said clubhead extending half the length of said clubhead from an extreme of said toe toward said heel to a central boundary defined by a vertical cut-plane positioned perpendicularly to the length line of said clubhead;

f. a toe weight means including at least one tow weight of the portion of said head weight means in said toe section as inertial weight;

g. a configuration of said toe section including:

(i) first and second substantial percentages of said toe weight means as an upper concentration of mass and a lower concentration of mass positioned adjacent said top and said toe and adjacent said sole and said toe, respectively, with each said concentration extending rearward from adjacent said rear surface of said striking means toward said back and between the extreme of said toe and said central boundary; and (ii) a generally minimal first local width approaching the width of said striking means adjacent said top between said central boundary and said upper concentration, a generally maximal second local width due to said upper concentration extending rearward adjacent said top and said toe, a generally minimal third local width approaching the width of said striking means due to the generally open space between said upper and lower concentrations adjacent said toe, and a generally maximal fourth local width due to the rearward extension of said lower concentration adjacent said sole said toe; and (iii) said maximal second local width generally greater than each of said minimal first and third local widths, and said maximal fourth local width also generally greater than said minimal third local width; whereby h. polar moments of inertia of said clubhead are enhanced to reduce twisting and loft changes when a golf ball is struck.

2. The golf clubhead of claim 1 whereby the far extent toward said toe of said upper concentration of mass and the far extent toward said toe of said lower concentration of mass are each generally positioned within about one-fourth the length of said clubhead from the extreme of said toe; and whereby the upper extent of said upper concentration of mass and the lower extent of said lower concentration of mass are generally positioned within about one-fourth the height of said clubhead from extremes of said top and said sole of said clubhead, respectively.

3. The gold clubhead of claim 2 whereby the length, width, and height of said upper concentration of mass extending rearward are generally between about one-twentieth to one-third the length of said clubhead, one-tenth to nine-tenths the width of said clubhead, and one-twentieth to one-third the height of said clubhead, respectively.

4. The golf clubhead of claim 3 whereby said maximal second local width is generally greater than each of said minimal first and third local widths by a factor of at least two.

5. The golf clubhead of claim 4 which is made of a unitary metallic casting.

6. A golf clubhead comprising:

a. a front together with a back, a top, a sole, a heel, and a toe;

b. a striking means to strike a ball including a ball striking surface toward said front and an external rear surface toward said back;

c. a fastening means to affix a shaft;

d. a head weight means comprising at least one head weight as inertial weight for said clubhead, and a binding means to attach said head weight means to said clubhead;

e. a toe section of said clubhead extending half of the length of said clubhead from an extreme of said toe toward said heel to a central boundary defined by a vertical cut-plant positioned perpendicularly to the length line of said clubhead;

f. a toe weight means including at least one toe weight of the portion of said head weight means in said toe section as inertial weight;

g. adjacent said rear surface, a configuration of said toe section including:

(i) first and second substantial percentages of said toe weight means as an upper concentration of mass and a lower concentration of mass positioned adjacent said top and said toe and adjacent said sole and said toe, respectively, with each said concentration extending rearward toward said back between the extreme of said toe and said central boundary;

(ii) said upper concentration, from limits between the extreme of said toe and said central boundary, extending rearward in compact form so that the central extent of said upper concentration toward said central boundary, as viewed from said top, is generally less than half the length of said clubhead from the extreme of said toe; and (iii) said upper concentration extending rearward substantially separated from said lower concentration along an outside toward the extreme of said toe, along an inside toward said central boundary, and along a bottom side toward said sole of said upper concentration; whereby, h. polar moments of inertia of said clubhead are enhanced to reduce twisting and loft changes when a golf ball is struck.

7. The golf clubhead of claim 6 whereby the far extent toward said toe of said upper concentration of mass and the far extent toward said toe of said lower concentration of mass are each generally positioned within about one-fourth the length of said clubhead from the extreme of said toe; and whereby the upper extent of said upper concentration of mass and the lower extent of said lower concentration of mass are generally positioned within about one-fourth the height of said clubhead from extremes of said top and said sole of said clubhead, respectively.

8. The golf clubhead of claim 7 whereby the length, width, and height of said upper concentration of mass extending rearward are between about one-twentieth to one-third the length of said clubhead, one-tenth to nine-tenths the width of said clubhead, and one-twentieth to one-third the height of said clubhead, respectively.

9. The golf clubhead of claim 8 which is made of a unitary metallic casting.

10. The golf clubhead of claim 9 whereby the width of said upper concentration of mass extending rearward is generally at least half of the width of said clubhead.

11. The golf clubhead of claim 10 whereby the upper corner portion of said toe section, which spans one-fourth the length of said clubhead from the extreme of said toe toward said central boundary to a vertical cut-plane positioned perpendicularly to the length line of said clubhead and which spans one-fourth the height of said clubhead from the extreme of said top toward said sole to a horizontal cut-plane, generally contains said upper concentration of mass.

12. The golf clubhead of claim 6 whereby said upper concentration of mass is attached directly to said external rear surface of said striking means, and extends rearward therefrom generally separated from the other components of said clubhead along the outside toward the extreme of said toe, along the inside toward said central boundary, along the topside toward said top, and along the bottom side toward said sole of said upper concentration.

13. The golf clubhead of claim 12 whereby the length, width, and height of said upper concentration of mass extending rearward are between about one-twentieth to one-third the length of said clubhead, one-tenth to nine-tenths the width of said clubhead, and one-twentieth to one-third the height of said clubhead, respectively, 14. The golf clubhead of claim 13 whereby the width of said upper concentration of mass extending rearward is at least half of the width of said clubhead.

15. The golf clubhead of claim 14 whereby the length and the width of said upper concentration extending rearward are both generally greater than the height of said upper concentration extending rearward.

16. The golf clubhead of claim 15 comprising:

a. an upper optimal edge approximately parallel to the width line of said clubhead positioned within about one-fourth the height of said clubhead from the extreme of said top and within about one-fourth the length of said clubhead from the extreme of said toe, whereby the portion of said upper concentration adjacent said top and said toe generally extends rearward along said upper optimal edge; and b. a lower edge approximately parallel to the width line of said clubhead positioned within about one-fourth the height of said clubhead from the extreme of said sole and within about one-fourth the length of said clubhead from the extreme of said toe, whereby the portion of said lower concentration adjacent said sole and said toe generally extends rearward along said lower optimal edge.

17. The golf clubhead of claim 16 whereby an upper corner portion of said toe section, which spans one-fourth the length of said clubhead from the extreme of said toe toward said central boundary to a vertical cut-plane positioned perpendicularly to the length line of said clubhead and which spans one-fourth the height of said clubhead from the extreme of said top toward said sole to a horizontal cut-plane, generally contains said upper concentration of mass extending rearward.

18. The golf clubhead of claim 17 whereby the loft compression ratio of the upper corner portion of said toe section is greater than about 1.0; and whereby the twist compression ratio of said upper corner sub-section is greater than about 0.75.

19. The golf clubhead of claim 17 which is made of a unitary metallic casting.

* * * * *

UNITED STATES PATENT AND TRADEMARK OFFICE

CERTIFICATE OF CORRECTION

PATENT NO. : 4,995,612

DATED : Feb. 26, 1991

INVENTOR(S) : Clifton D. Finney

It is certified that error appears in the above-identified patent and that said Letters Patent is hereby corrected as shown below:

Title page, notice line, change "Jan. 15, 2007" to --Jan. 15, 2008--.

Col 14, line 6, after "weights" insert the following heading:

--TABLE II. Moments and inertia and inertial efficiencies for 300 gram cavity-back and corner-back near-clubheads of BeCu at 8.47 $gcm^{-3}$. In Parts B and C the open values are results from formula calculations, and values in parentheses are results from mass-bit computations.--.

UNITED STATES PATENT AND TRADEMARK OFFICE

CERTIFICATE OF CORRECTION

PATENT NO. : 4,995,612

DATED : Feb. 26,1991

INVENTOR(S) : Clifton D. Finney

It is certified that error appears in the above-identified patent and that said Letters Patent is hereby corrected as shown below:

Col 14, line 20, after "0.200"" insert the following parts of TABLE II:

--Part C. Results for vertical axes

| y-Axis 416 (FIG. 12) | | y-Axis 470 (FIG. 13) | |
|---|---|---|---|
| I (g-cm 2) | Efficiency | I (g-cm 2) | Efficiency |
| 4,290 | 0.354 | 5,440 | 0.450 |
| (4,460) | (0.368) | (5,930) | (0.490) |

UNITED STATES PATENT AND TRADEMARK OFFICE

CERTIFICATE OF CORRECTION

PATENT NO. : 4,995,612

DATED : Feb. 26, 1991

INVENTOR(S) : Clifton D. Finney

It is certified that error appears in the above-identified patent and that said Letters Patent is hereby corrected as shown below:

Part D. Results for horizontal axes

| z-Axis 418 (FIG. 12) | | z-Axis 472 (FIG. 13) | |
|---|---|---|---|
| I (g-cm $^2$) | Efficiency | I (g-cm $^2$) | Efficiency |
| 204 | 0.422 | 213 | 0.440 |
| (372) | (0.769) | (701) | (1.45)--. |

Signed and Sealed this

Third Day of November, 1992

*Attest:*

DOUGLAS B. COMER

*Attesting Officer*

*Acting Commissioner of Patents and Trademarks*